US012514426B2

(12) United States Patent
Lee et al.

(10) Patent No.: US 12,514,426 B2
(45) Date of Patent: Jan. 6, 2026

(54) DISH WASHER

(71) Applicant: LG Electronics Inc., Seoul (KR)

(72) Inventors: Sung Hun Lee, Seoul (KR); Minhyuk Lee, Seoul (KR); Daegyu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 28 days.

(21) Appl. No.: 18/390,873

(22) Filed: Dec. 20, 2023

(65) Prior Publication Data

US 2024/0197143 A1 Jun. 20, 2024

(30) Foreign Application Priority Data

Dec. 20, 2022 (KR) ..... 10-2022-0179505

(51) Int. Cl.
*A47L 15/44* (2006.01)
*A47L 15/00* (2006.01)

(52) U.S. Cl.
CPC ..... *A47L 15/449* (2013.01); *A47L 15/0021* (2013.01); *A47L 15/0049* (2013.01); *A47L 15/0055* (2013.01); *A47L 15/4418* (2013.01); *A47L 2401/02* (2013.01); *A47L 2401/20* (2013.01); *A47L 2501/07* (2013.01); *A47L 2501/26* (2013.01); *A47L 2501/30* (2013.01); *A47L 2501/32* (2013.01)

(58) Field of Classification Search
CPC ..... A47L 15/0055; A47L 15/4418; A47L 15/4463; A47L 15/449; A47L 15/00–508
See application file for complete search history.

(56) References Cited

U.S. PATENT DOCUMENTS

2003/0127110 A1 7/2003 Reichold et al.
2015/0300348 A1* 10/2015 Bach ..... F04B 43/1261 417/32
2018/0010950 A1 1/2018 Ismail et al.
2024/0315525 A1* 9/2024 Sahlén ..... A47L 15/4418

FOREIGN PATENT DOCUMENTS

DE 3812109 A1 10/1989
WO WO 2021/245620 A1 12/2021

OTHER PUBLICATIONS

Extended European Search Report in European Appln. No. 23218809.4, mailed on May 17, 2024, 7 pages.

* cited by examiner

*Primary Examiner* — Spencer E. Bell
(74) *Attorney, Agent, or Firm* — Fish & Richardson P.C.

(57) ABSTRACT

A dish washer effectively identifies a viscosity of a detergent stored in a detergent supply based on the number of revolutions of a roller sensed via a roller sensor and an operating time of a pump motor, thereby simplifying a structure, improving space utilization, and reducing a manufacturing cost as a separate electrode sensor or level sensor for identifying the viscosity of the detergent is eliminated.

20 Claims, 30 Drawing Sheets

DISH WASHER

CROSS-REFERENCE TO RELATED APPLICATION

This application claims priority to and benefit of Korean Patent Application No. 10-2022-0179505, filed on Dec. 20, 2022, which is hereby incorporated by reference as when fully set forth herein.

TECHNICAL FIELD

The present disclosure relates to a dish washer, and more specifically, to a dish washer that may effectively identify a viscosity of a detergent stored in a detergent supply based on the number of revolutions of a roller sensed via a roller sensor and an operating time of a pump motor, thereby simplifying a structure, improving space utilization, and reducing a manufacturing cost as a need for a separate electrode sensor or level sensor to identify the viscosity of the detergent is eliminated.

BACKGROUND

A dish washer is an apparatus that washes a dish, a cooking utensil, and the like, which are objects-to-be-washed stored therein, by spraying washing water, such as water, thereto. In this regard, the washing water used for the washing may contain a detergent.

The dish washer generally includes a tub that defines a washing space therein, a storage that accommodates the objects-to-be-washed inside the tub, a spray arm that sprays the washing water into the storage, and a sump that stores water therein and supplies the washing water into the spray arm.

As such dish washer is used, time and effort required to wash the objects-to-be-washed such as the dish after a meal may be reduced, contributing to user convenience.

The detergent used for the washing may be supplied into the tub via a detergent supply. The detergent supplied into the tub may be mixed with water to create the washing water.

In general, the detergent supply may be composed of a container that stores the detergent therein, and a detergent pump that pumps the detergent stored in the container into the tub.

In relation, in International Patent Application Publication No. 2021-245620 (Prior art literature 001), disclosed is a dish washer that supplies the detergent via a tube pump-type dispenser, wherein the dispenser allows a user to select a washing process mode suitable for the viscosity or viscosity characteristics of the detergent by placing a separate electrode sensor or level sensor for sensing the viscosity or the viscosity characteristics of the detergent therein.

However, the structure disclosed in prior art literature 001 requires the separate electrode sensor for sensing the viscosity of the detergent inside the dispenser, which worsens space utilization, makes the structure complicated to a certain extent, and significantly increases a manufacturing cost.

PRIOR ART LITERATURE

Patent Document (Patent Document 001) International Patent Application Publication No. 2021-245620

SUMMARY

The present disclosure was designed to solve the problems of the prior art described above, and has a first purpose of providing a dish washer that may effectively identify a viscosity of a detergent stored in a detergent supply based on the number of revolutions of a roller sensed via a roller sensor and an operating time of a pump motor, thereby simplifying a structure, improving space utilization, and reducing a manufacturing cost as a need for a separate electrode sensor or level sensor for identifying the viscosity of the detergent is eliminated.

In addition, the present disclosure has a second purpose of providing a dish washer that may automatically select a washing process mode suitable for a viscosity of a detergent, thereby improving user convenience.

In addition, the present disclosure has a third purpose of providing a dish washer that, when a viscosity of a stored detergent is high enough to be unsuitable for a detergent pump, stops operation of a detergent pump and instructs a user to replace the detergent with a suitable detergent to effectively prevent damage to the detergent pump.

Purposes of the present disclosure are not limited to the above-mentioned purpose. Other purposes and advantages of the present disclosure that are not mentioned may be understood based on following descriptions, and may be more clearly understood based on embodiments of the present disclosure. Further, it will be easily understood that the purposes and advantages of the present disclosure may be realized using means shown in the claims and combinations thereof.

A first aspect of the present disclosure provides a dish washer including a tub having a washing space defined therein, a detergent supply including a container that stores therein a detergent to be provided to the washing space, and a detergent pump that supplies the detergent stored in the container to the washing space, and a controller that controls operation of the detergent pump while a washing process is in progress, wherein the detergent pump includes a tube that guides the detergent discharged from the container to the washing space, a roller that pressurizes the tube and revolves around a revolution axis to allow the detergent inside the tube to flow, a pump motor that generates a driving force to move the roller, and a roller sensor that senses a location of the roller and generates an output signal corresponding to the location of the roller, wherein the controller determines a state of the detergent pump or a state of the detergent based on the output signal received from the roller sensor, and stops the washing process or selects a mode of the washing process suitable for the state of the detergent and performs the washing process based on the selected mode of the washing process based on the state of the detergent pump or the state of the detergent determined in the determining of the state of the detergent pump or the state of the detergent.

In one implementation of the first aspect, the determining of the state of the detergent pump or the state of the detergent may include initiating the operation of the pump motor and initiating measurement of an elapsed time after the operation of the pump motor is initiated, and determining whether a preset amount of detergent has been supplied based on the output signal received from the roller sensor after the measurement of the elapsed time is initiated.

In one implementation of the first aspect, the determining of whether the preset amount of detergent has been supplied may include receiving the output signal including one of a first output signal and a second output signal from the roller sensor, determining whether a change from the first output signal to the second output signal or a change from the second output signal to the first output signal of the received output signal has initially occurred, determining an initial change state of the output signal when it is determined that the initial change of the output signal has occurred in the determining of whether the change of the output signal has initially occurred, determining whether a change of the output signal the same as the initial change state has occurred after determining the initial change state, increasing the number of signal changes by one and storing the updated number of signal changes when it is determined that the change of the output signal the same as the initial change has occurred in the determining of whether the change of the output signal the same as the initial change state has occurred, and comparing the updated number of signal changes with the preset number.

In one implementation of the first aspect, the first output signal may include a signal containing information indicating that the roller is within a sensing range of the roller sensor, the second output signal may include a signal containing information indicating that the roller is at a location out of the sensing range of the roller sensor, and the initial change state may be one of a first change state of changing from the first output signal to the second output signal and a second change state of changing from the second output signal to the first output signal.

In one implementation of the first aspect, the controller may further re-receive the output signal from the roller sensor after the determining of the initial change state of the output signal.

In one implementation of the first aspect, the controller may further determine that the supply of the preset amount of detergent has been completed when it is determined that the updated number of signal changes has reached the preset number in the comparing of the updated number of signal changes with the preset number.

In one implementation of the first aspect, the number of signal changes may become the number of revolutions of the roller.

In one implementation of the first aspect, the determining of the state of the detergent pump or the state of the detergent may include determining that a preset amount of detergent has been supplied and stopping the operation of the pump motor based on the output signal received from the roller sensor after the operation of the pump motor is initiated, and comparing an elapsed time from the initiation of the operation of the pump motor to the stopping of the operation of the pump motor with a predetermined set time, and a fact that an error has occurred in the detergent pump may be determined or the mode of the washing process may be determined based on a result of the comparing of the elapsed time with the predetermined set time.

In one implementation of the first aspect, the stopping of the washing process or the selecting of the mode of the washing process suitable for the state of the detergent and the performing of the washing process based on the selected mode of the washing process may include determining the mode of the washing process to be a first mode when it is determined that the elapsed time is shorter than a first set time, and determining the mode of the washing process to be a second mode when it is determined that the elapsed time is equal to or longer than the first set time and shorter than a second set time, and determining to stop the washing process when it is determined that the elapsed time is equal to or longer than the second set time and shorter than a third set time.

In one implementation of the first aspect, the determining of the fact that the error has occurred in the detergent pump or the determining of the mode of the washing process may further include determining that the error has occurred in the detergent pump when it is determined that the elapsed time is equal to or longer than a third set time in the comparing of the elapsed time with the predetermined set time, the stopping of the washing process or the selecting of the mode of the washing process suitable for the state of the detergent and the performing of the washing process based on the selected mode of the washing process may include determining to stop the washing process, generating a visual alarm or an auditory alarm containing predetermined information via a display or a sound outputter, or transmitting a signal containing the predetermined information to a terminal of a user when it is determined that the error has occurred in the detergent pump, and the predetermined information may include information indicating that the error has occurred in the detergent pump or information indicating that the washing process needs to be stopped.

A second aspect of the present disclosure provides a method for controlling a dish washer including a detergent supply including a container that stores therein a detergent to be provided to a washing space, and a detergent pump that supplies the detergent stored in the container to the washing space including determining a state of the detergent pump or a state of the detergent based on an output signal received from a roller sensor that senses a location of a roller disposed in the detergent pump, and stopping a washing process or selecting a mode of the washing process suitable for the state of the detergent and performing the washing process based on the selected mode of the washing process based on the state of the detergent pump or the state of the detergent determined in the determining of the state of the detergent pump or the state of the detergent.

In one implementation of the second aspect, the determining of the state of the detergent pump or the state of the detergent may include initiating operation of a pump motor and initiating measurement of an elapsed time after the operation of the pump motor is initiated, and determining whether a preset amount of detergent has been supplied based on the output signal received from the roller sensor after the measurement of the elapsed time is initiated.

In one implementation of the second aspect, the determining of whether the preset amount of detergent has been supplied may include receiving the output signal including one of a first output signal and a second output signal from the roller sensor, determining whether a change from the first output signal to the second output signal or a change from the second output signal to the first output signal of the received output signal has initially occurred, determining an initial change state of the output signal when it is determined that the initial change of the output signal has occurred in the determining of whether the change of the output signal has initially occurred, determining whether a change of the output signal the same as the initial change state has occurred after determining the initial change state, increasing the number of signal changes by one and storing the updated number of signal changes when it is determined that the change of the output signal the same as the initial change has occurred in the determining of whether the change of the output signal the same as the initial change state has occurred, and comparing the updated number of signal changes with the preset number.

In one implementation of the second aspect, the first output signal may include a signal containing information indicating that the roller is within a sensing range of the roller sensor, the second output signal may include a signal containing information indicating that the roller is at a location out of the sensing range of the roller sensor, and the initial change state is one of a first change state of changing from the first output signal to the second output signal and a second change state of changing from the second output signal to the first output signal.

In one implementation of the second aspect, the method may further include re-receiving the output signal from the roller sensor after the determining of the initial change state of the output signal.

In one implementation of the second aspect, the method may further include determining that the supply of the preset amount of detergent has been completed when it is determined that the updated number of signal changes has reached the preset number in the comparing of the updated number of signal changes with the preset number.

In one implementation of the second aspect, the number of signal changes may become the number of revolutions of the roller.

In one implementation of the second aspect, the determining of the state of the detergent pump or the state of the detergent may include determining that a preset amount of detergent has been supplied and stopping operation of the pump motor based on the output signal received from the roller sensor after the operation of the pump motor is initiated, and comparing an elapsed time from the initiation of the operation of the pump motor to the stopping of the operation of the pump motor with a predetermined set time, and a fact that an error has occurred in the detergent pump may be determined or the mode of the washing process may be determined based on a result of the comparing of the elapsed time with the predetermined set time.

In one implementation of the second aspect, the stopping of the washing process or the selecting of the mode of the washing process suitable for the state of the detergent and the performing of the washing process based on the selected mode of the washing process may include determining the mode of the washing process to be a first mode when it is determined that the elapsed time is shorter than a first set time, and determining the mode of the washing process to be a second mode when it is determined that the elapsed time is equal to or longer than the first set time and shorter than a second set time, and determining to stop the washing process when it is determined that the elapsed time is equal to or longer than the second set time and shorter than a third set time.

In one implementation of the second aspect, the determining of the fact that the error has occurred in the detergent pump or the determining of the mode of the washing process may further include determining that the error has occurred in the detergent pump when it is determined that the elapsed time is equal to or longer than a third set time in the comparing of the elapsed time with the predetermined set time, the stopping of the washing process or the selecting of the mode of the washing process suitable for the state of the detergent and the performing of the washing process based on the selected mode of the washing process may include determining to stop the washing process, generating a visual alarm or an auditory alarm containing predetermined information via a display or a sound outputter, or transmitting a signal containing the predetermined information to a terminal of a user when it is determined that the error has occurred in the detergent pump, and the predetermined information may include information indicating that the error has occurred in the detergent pump or information indicating that the washing process needs to be stopped.

The dish washer according to the present disclosure may simplify the structure, improve the space utilization, and reduce the manufacturing cost as the separate electrode sensor or level sensor for identifying the viscosity of the detergent is eliminated.

In addition, the dish washer according to the present disclosure may automatically select the washing process mode suitable for the viscosity of the detergent, thereby improving the user convenience.

In addition, the dish washer according to the present disclosure may stop the operation of the detergent pump and instruct the user to replace the detergent with the suitable detergent when the viscosity of the stored detergent is high enough to be unsuitable for the detergent pump, thereby effectively preventing the damage to the detergent pump.

In addition to the above-mentioned effects, specific effects of the present disclosure will be described below while describing the specific details for carrying out the invention.

DETAILED DESCRIPTION

Figure 1:
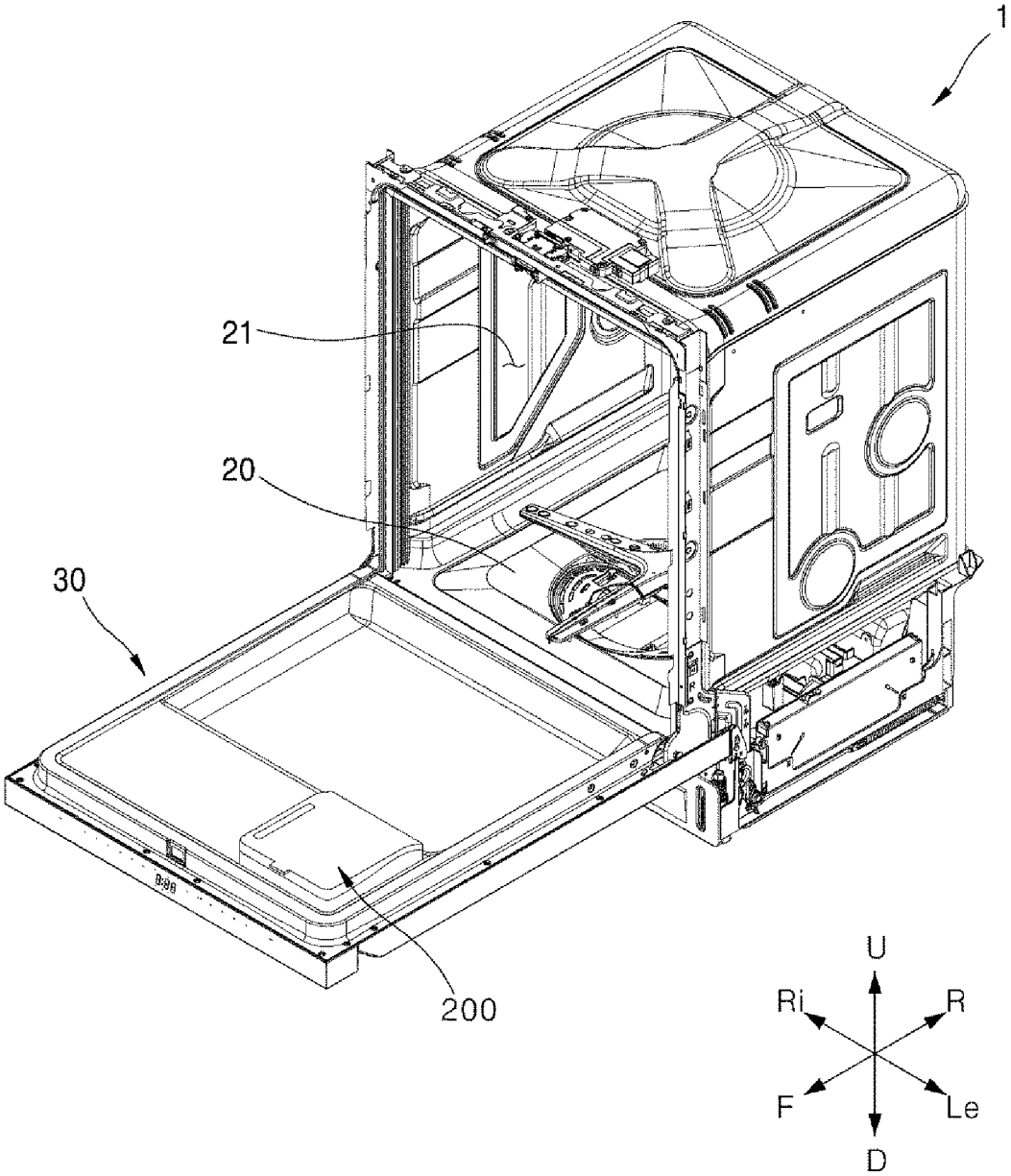
FIG. 1 is a front perspective view of a dish washer according to an embodiment of the present disclosure.

The above-mentioned purposes, features, and advantages will be described in detail later with reference to the attached drawings, so that those skilled in the art in the technical field to which the present disclosure belongs may easily implement the technical ideas of the present disclosure. In describing the present disclosure, when it is determined that a detailed description of the publicly known technology related to the present disclosure may unnecessarily obscure the gist of the present disclosure, the detailed description will be omitted. Hereinafter, a preferred embodiment according to the present disclosure will be described in detail with reference to the attached drawings. In the drawings, identical reference numerals are used to indicate identical or similar components.

Although first, second, and the like are used to describe various components, these components are not limited by such terms. Such terms are only used to distinguish one component from another component, and unless specifically stated to the contrary, a first component may also be a second component.

Throughout the present document, unless otherwise stated, each component may be singular or plural.

Hereinafter, a first component being disposed "on top of (or under)" a second component may mean that the first component may be disposed in contact with a top surface (or a bottom surface) of the second component, as well as a third component may be interposed between the second component and the first component disposed "on top of (or under)" the second component.

Furthermore, when a first component is described as being "connected" or "coupled" to a second component, the components may be directly connected or coupled to each other, but a third component may be "interposed" between the components or the components may be "connected" or "coupled" to each other via the third components.

As used herein, the singular constitutes "a" and "an" are intended to include the plural constitutes as well, unless the context clearly indicates otherwise. In this application, terms such as "composed of" or "include" should not be construed as necessarily including all of various components or steps described herein, but should be construed that some components or steps among those may not be included or additional components or steps may be further included.

As used herein, the singular constitutes "a" and "an" are intended to include the plural constitutes as well, unless the context clearly indicates otherwise. In this application, terms such as "composed of" or "include" should not be construed as necessarily including all of various components or steps described herein, but should be construed that some components or steps among those may not be included or additional components or steps may be further included.

Throughout the present document, "A and/or B" means A, B, or A and B, unless otherwise specified, and "C to D" means equal to or greater than C and equal to or smaller than D unless otherwise specified.

[Overall Structure of Dish Washer]

Hereinafter, an overall structure of a dish washer 1 according to one embodiment of the present disclosure will be described in detail with reference to attached drawings.

Figure 2:
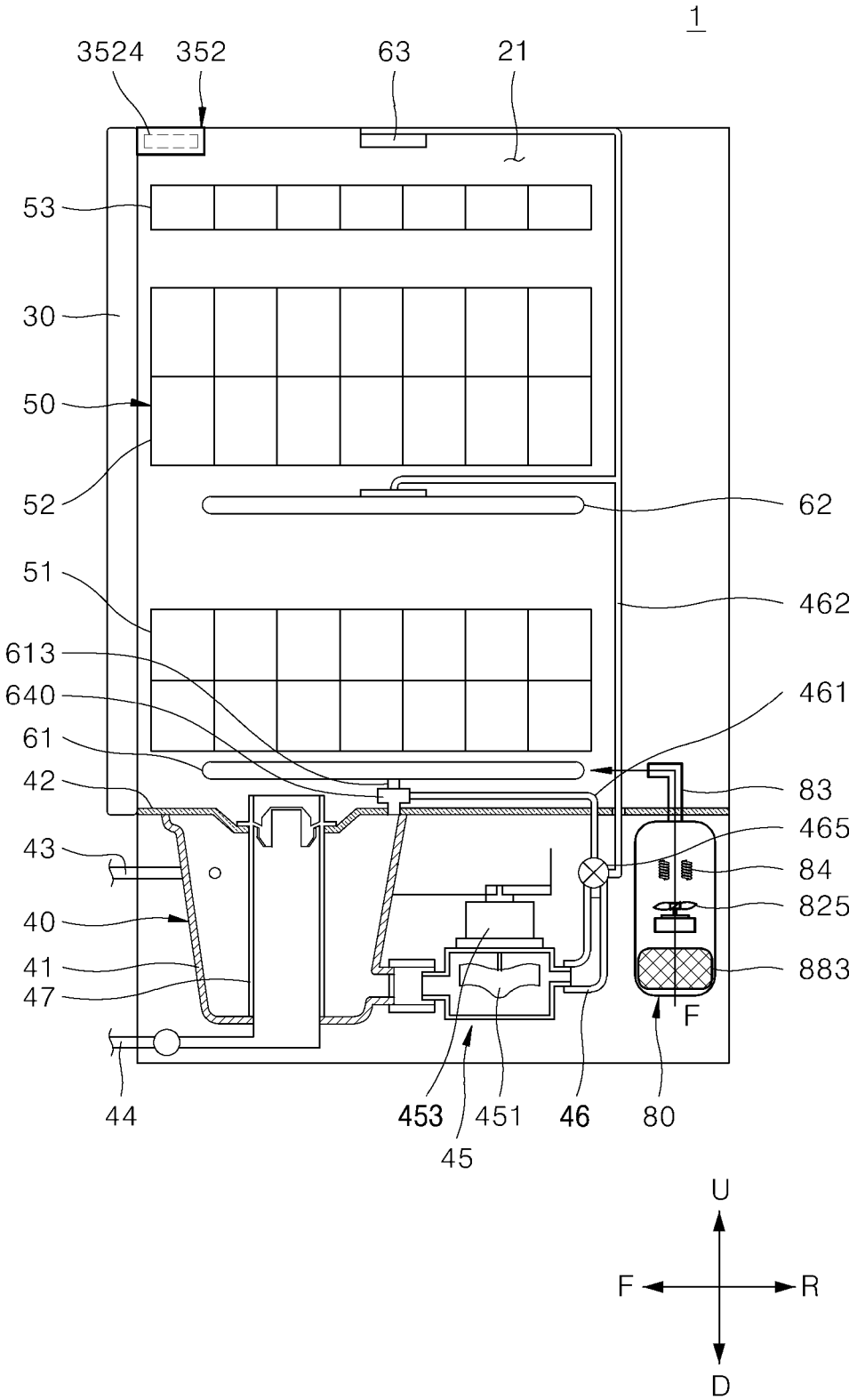
FIG. 2 is a simplified cross-sectional view of a dish washer shown in FIG. 1.

FIG. 1 is a front perspective view showing a dish washer according to the present disclosure, and FIG. 2 is a simplified cross-sectional view simply showing an internal structure of a dish washer according to the present disclosure.

As shown in FIGS. 1 and 2, the dish washer 1 according to one embodiment of the present disclosure includes a casing 10 that forms an outer appearance of the dish washer, a tub 20 that is installed inside the casing 10, defines therein a washing space 21 in which objects-to-be-washed are washed, and has an open front surface, a door 30 that opens and closes the open front surface of the tub 20, a driver 40 that is located beneath the tub 20 and supplies, collects, circulates, and drains washing water for washing the objects-to-be-washed, a storage 50 that is removably disposed in the internal washing space 21 of the tub 20 and where the objects-to-be-washed are placed, and a spray 60 that is installed adjacent to the storage 50 and sprays the washing water for washing the objects-to-be-washed.

In this regard, the objects-to-be-washed placed in the storage 50 may be, for example, dishes such as a bowl, a plate, a spoon, chopsticks, and other cooking utensils. Hereinafter, unless otherwise specified, the objects-to-be-washed will be referred to as the dishes.

The tub 20 may be formed in a box shape with the entirely open front surface, and may correspond to a component known as a so-called washing tank.

The washing space 21 may be defined inside the tub 20, and the open front surface may be opened and closed by the door 30.

The tub 20 may be formed via press processing of a metal plate resistant to high temperature and moisture, for example, a stainless steel plate.

In addition, a number of brackets for allowing functional components such as the storage 50 and the spray 60, which will be described later, to be supported and installed inside the tub 20 may be disposed on an inner surface of the tub 20.

In one example, the driver 40 may be composed of a sump 41 that stores the washing water therein, a sump cover 42 that separates the sump 41 from the tub 20, a water supply 43 that supplies the washing water to the sump 41 from the outside, a drainage 44 that drains the washing water of the sump 41 to the outside, and a water supply pump 45 and a supply passage 46 for supplying the washing water of the sump 41 to the spray 60.

The sump cover 42 may be disposed on the sump 41 and may serve to separate the tub 20 from the sump 41. Additionally, the sump cover 42 may have a plurality of recovery holes to recover the washing water sprayed into the washing space 21 via the spray 60 to the sump 41.

In other words, the washing water sprayed from the spray 60 toward the dishes may fall to a bottom of the washing space 21, pass through the sump cover 42, and be recovered back into the sump 41.

The water supply pump 45 is disposed next to or below the sump 41 and serves to pressurize the washing water and supply the washing water to the spray 60.

One end of the water supply pump 45 may be connected to the sump 41 and the other end thereof may be connected to the supply passage 46. The water supply pump 45 may have an impeller 451, a motor 453, and the like. When power is supplied to the motor 453, the impeller 451 may rotate, and the washing water in the sump 41 may be pressurized and then be supplied to the spray 60 via the supply passage 46.

In one example, the supply passage 46 may serve to selectively supply the washing water supplied from the water supply pump 45 to the spray 60.

For example, may supply passage 46 may include a first supply passage 461 connected to a lower spray arm 61, and a second supply passage 463 connected to an upper spray arm 62 and a top nozzle 63. The supply passage 46 may include a supply passage switching valve 465 that selectively opens and closes the supply passages 461 and 463.

In this regard, the supply passage switching valve 465 may be controlled such that the supply passages 461 and 463 are sequentially opened or simultaneously opened.

In one example, the spray 60 is constructed to spray the washing water to the dishes or the like stored in the storage 50.

More specifically, the spray 60 may include the lower spray arm 61 that is located at the bottom of the tub 20 and sprays the washing water to a lower rack 51, the upper spray arm 62 that is located between the lower rack 51 and the upper rack 52 and sprays the washing water to the lower rack 51 and the upper rack 52, and the top nozzle 63 that is located at a top of the tub 20 and sprays the washing water to the top rack 53 or the upper rack 52.

In particular, the lower spray arm 61 and the upper spray arm 62 may be rotatably disposed in the washing space 21 of the tub 20 to spray the washing water while rotating toward the dishes in the storage 50.

The lower spray arm 61 may be rotatably supported above the sump cover 42 so as to spray the washing water while rotating toward the lower rack 51 from below the lower rack 51.

In addition, the upper spray arm 62 may be rotatably supported by a spray arm holder 467 so as to spray the washing water while rotating between the lower rack 51 and the upper rack 52.

In one example, means for diverting the washing water sprayed from the lower spray arm 61 to an upward direction (a U-direction) may be further disposed on a bottom surface 25 of the tub 20 to increase a washing efficiency.

In one example, the washing space 21 may have the storage 50 for storing the dishes.

The storage 50 is constructed to be extendable from the inside of the tub 20 via the open front surface of the tub 20.

For example, in FIG. 2, an embodiment with the lower rack 51 that is located at the bottom of the tub 20 and accommodates relatively large dishes therein, the upper rack 52 that is located above the lower rack 51 and accommodates medium-sized dishes therein, and the top rack 53 that is located at the top of the tub 20 and accommodates small dishes therein is shown. The present disclosure is not limited thereto, but a description will be made based on the embodiment of the dish washer with the three storages 50 as shown.

Such lower rack 51, upper rack 52, and top rack 53 may be constructed to be extendable via the open front surface of the tub 20.

To this end, guide rails (not shown) may be disposed on both side walls forming inner peripheral surfaces of the tub 20. For example, the guide rail may include an upper rail, a lower rail, and a top rail.

Wheels may be disposed beneath the lower rack 51, the upper rack 52, and the top rack 53, respectively. A user may store the dishes in the lower rack 51, the upper rack 52, and the top rack 53 by extending the racks to the outside via the front surface of the tub 20, or easily pull the dishes that have been washed from the racks.

A guide rail 54 may be formed as a fixed guide rail in a form of a simple rail to guide extension and retraction of the spray 60, or a telescopic guide rail that guides the extension and the retraction of the spray 60 and increases an extension distance thereof as the spray 60 extends.

In one example, the door 30 has the purpose of opening and closing the open front surface of the tub 20 described above.

A hinge (not shown) for opening and closing the door 30 may be generally disposed at a bottom of the open front surface, and the door 30 may be opened by pivoting with the hinge as a pivoting axis.

In this regard, a handle for opening the door 30 and a control panel for controlling the dish washer 1 may be disposed on an outer surface of the door 30.

As shown, the control panel may include a display that visually displays information on a current operating state or the like of the dish washer, and a button including a selection button through which a selection manipulation of the user is input and a power button through which a manipulation of the user to turn on and off the dish washer is input.

In one example, a rear panel forming an inner surface of the door 30 may form one surface of the tub 20 when the door 30 is closed, and at the same time, may form a seating surface on which the lower rack 51 of the storage 50 may be supported when the door 30 is fully opened.

To this end, it is desirable that, when the door 30 is fully opened, the rear panel of the door 30 forms a horizontal plane in the same direction as the guide rail 54 where the lower rack 51 is guided extends.

In addition, although not shown in FIGS. 1 and 2, a detergent supply where a detergent for washing the objects-to-be-washed is stored and for automatically supplying an appropriate amount of detergent during a washing process may be disposed on the rear panel of the door 30.

The appropriate amount of detergent may be determined based on a washing load, that is, a total amount of objects-to-be-washed.

A description on detailed components of the detergent supply will be made later with reference to FIG. 3A and subsequent drawings.

In one example, as shown in FIG. 2, an automatic door opening module 352 for automatically opening the door may be disposed at an outer side of a top surface of the tub 20.

As an example, the automatic door opening module 352 may have a push rod 3524 that pivots an upper end of the rear surface of the door 30 to an open location.

In one example, a drying wind supply 80 for generating high or low temperature drying wind and supplying the drying wind to the washing space inside the tub 20 may be disposed at a lower portion of the tub 20.

As shown, the drying wind supply 80 may be composed of a filter member 883 that filters external air, a blowing fan 825 that generates a drying wind airflow, a heater 84 that heats the drying wind airflow, and an airflow guide 83 that is disposed inside the tub and guides the drying wind airflow.

A drying wind supply hole 254 may be defined in a bottom surface of the tub 20 such that high-temperature drying wind generated from the drying wind supply may be introduced into the tub 20.

[Detailed Configuration of Detergent Supply]

As described above, a detergent supply 200 disposed in the dish washer 1 according to one embodiment of the present disclosure may be disposed on and attached to the door 30.

Figure 3A:
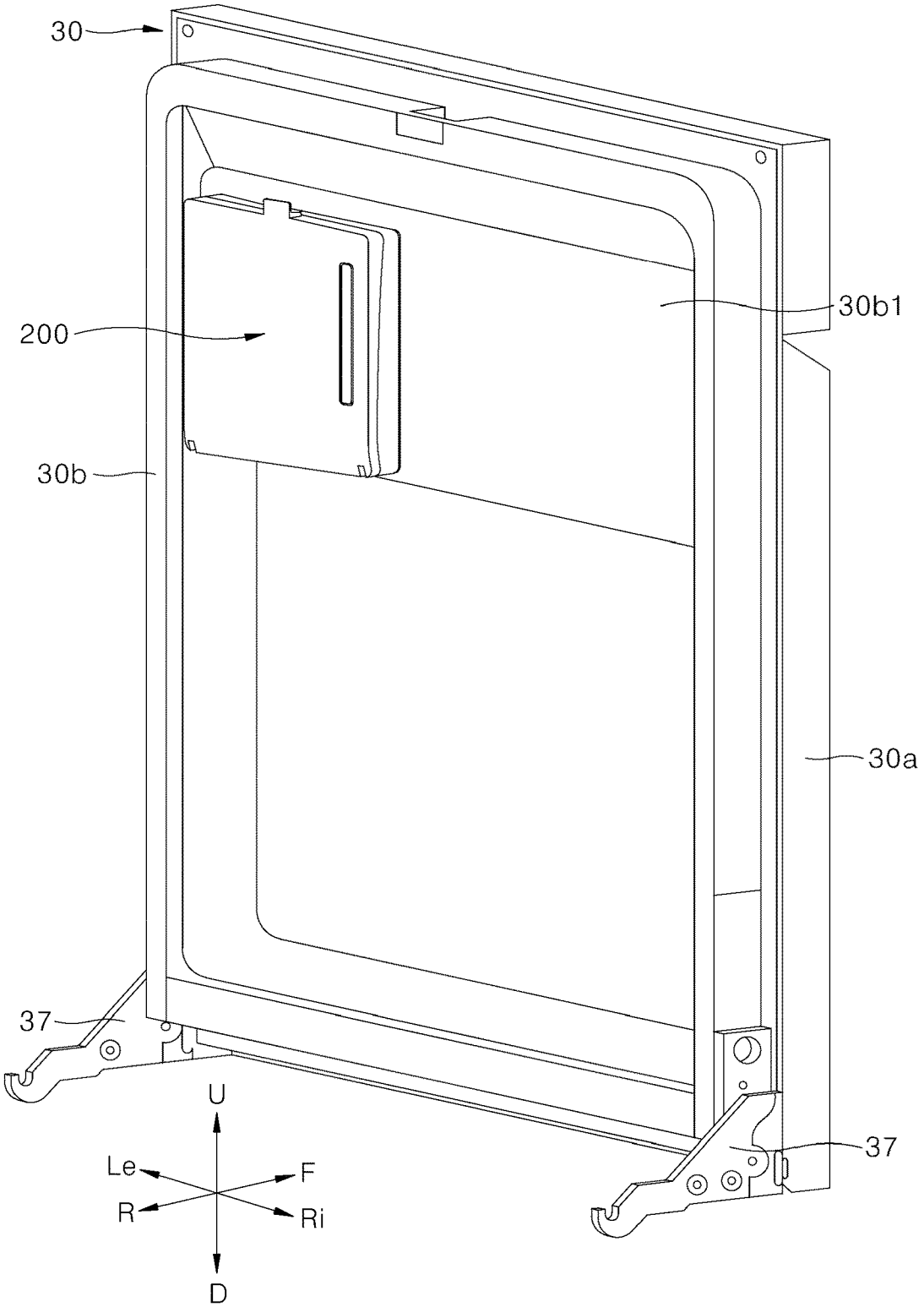
FIG. 3A is a rear perspective view showing a detergent supply according to an embodiment of the present disclosure attached to a rear panel of a door.
Figure 3B:
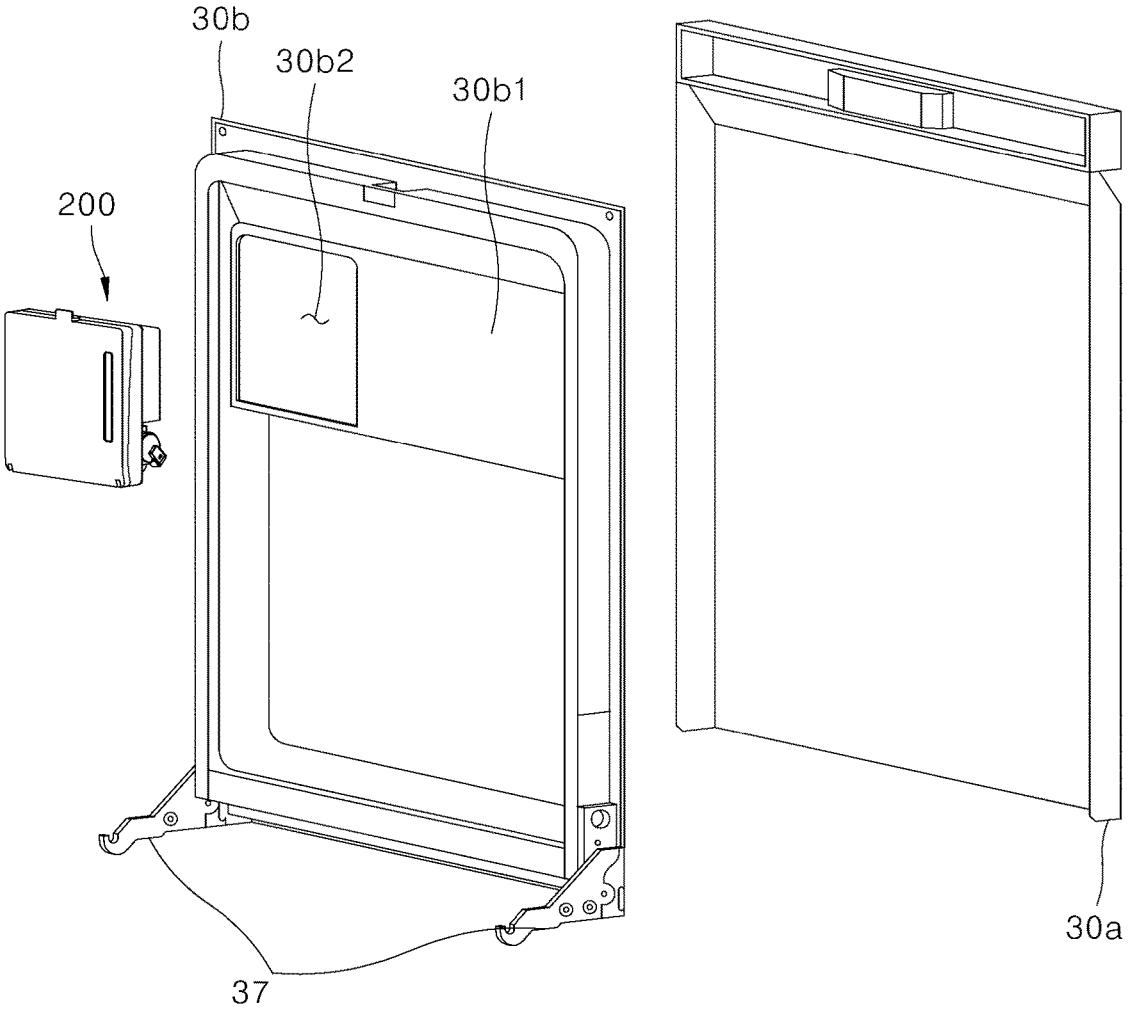
FIGS. 3B and 3C are exploded perspective views of FIG. 3A.
Figure 3C:
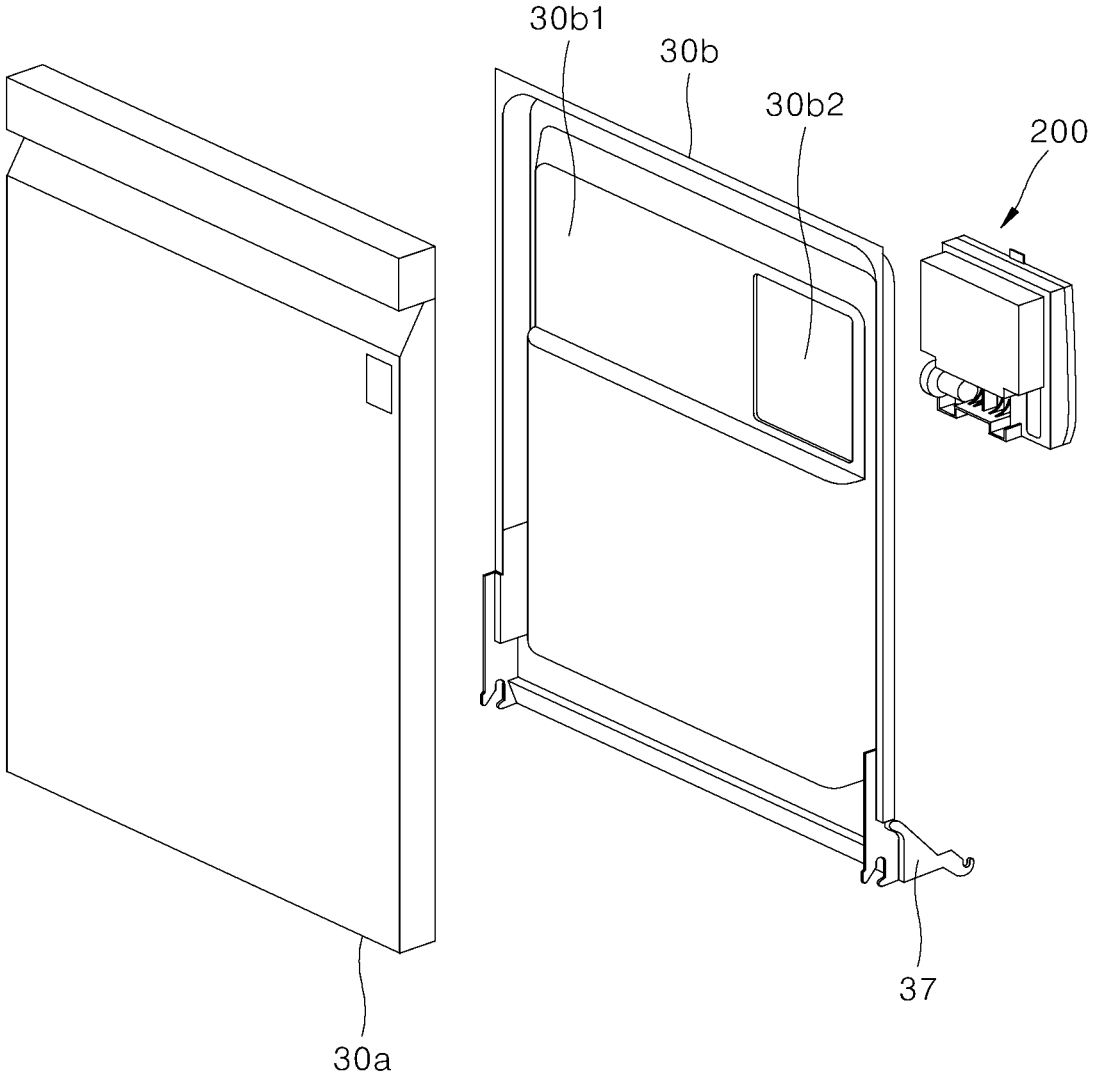

As shown in FIGS. 3A to 3C, the door 30 may include a front panel 30*a* that forms a front surface of the dish washer 1, and a rear panel 30*b* that is coupled to the front panel 30*a* and disposed to face the inside of the tub 20 to form the rear surface of the door 30.

In this regard, the detergent supply 200 may be coupled to the rear panel 30*b* that forms the rear surface of the door 30.

As shown, a concave portion that is concavely recessed toward the front panel 30*a* may be defined at a lower portion of the rear panel 30*b*, and the concave portion may not be defined at an upper portion of the rear panel 30*b*. Therefore, a rear protruding surface 30*b*1 that protrudes further rearwardly of the upper portion may be formed at the upper portion of the rear panel 30*b*.

As will be described later, because a predetermined detergent storage capacity must be secured inside the detergent supply 200, a width in a front and rear direction of the detergent supply 200 needs to be quite great.

Considering the width in the front and rear direction of the detergent supply 200, the detergent supply 200 may be coupled to the rear protruding surface 30*b*1 at the upper portion of the rear panel 30*b* where the concave portion is not defined.

In this regard, the detergent supply 200 may partially extend into the door 30 through the rear panel 30*b*. To this end, a through-hole 30*b*2 through which the detergent supply 200 partially passes may be defined in the rear protruding surface 30*b*1 of the rear panel 30*b*. The through-hole 30*b*2 may have approximately a square hole shape corresponding to an outer appearance of the detergent supply 200.

Therefore, based on the closed state of the door 30, a rear portion of the detergent supply 200 may be exposed to the washing space 21 of the tub 20, and a front portion of the detergent supply 200 may pass through the rear panel 30*b* and be disposed inside the door 30.

In this regard, as will be described later, electrical components such as a detergent pump 230, a roller sensor 2391, and the like that are electrically operated may be disposed in the front portion of the detergent supply 200 disposed inside the door 30. Therefore, the electrical components constituting the detergent supply 200 may be not affected by the washing water.

Furthermore, as described above, a number of electrically operated components, in addition to the electrical components of the detergent supply 200, may be accommodated inside the door 30. To prevent the components from being affected by the washing water, water leak preventing means may be disposed between the detergent supply 200 and the rear panel 30*b* of the door 30.

As described above, the door 30 may be pivotably supported via a hinge bracket 37 disposed at a lower end of the door 30, and may be pivoted around the hinge bracket 37.

When the door 30 is closed, the detergent supply 200 may be disposed to face the inside of the washing space 21 and may be directed in a vertical direction. As such, when the detergent supply 200 is directed in the vertical direction, the detergent stored inside the detergent container 280, which will be described later, may flow downward based on gravity.

Additionally, when the door 30 is opened, the detergent supply 200 may be pivoted in a direction away from the tub 20, and may be directed in a horizontal direction in the full open state of the door 30.

After opening the door 30 and directing the detergent supply 200 in the horizontal direction, the user may open a cover 220 to be described later and mount the detergent container 280 inside the housing 210 or easily remove the detergent container 280 from the housing 210.

Hereinafter, a detailed structure of the detergent supply 200 will be described with reference to FIGS. 4 to 7.

FIGS. 4 to 7 show the aforementioned state in which the door 30 is closed and the detergent supply 200 is directed in the vertical direction. Hereinafter, unless otherwise described, a description will be made based on the state in which the detergent supply 200 is directed in the vertical direction.

First, the detergent supply 200 may include the housing 210 having a predetermined receiving space defined therein, and the cover 220 that opens and closes the receiving space of the housing 210.

The housing 210 forms an exterior of the detergent supply 200 and serves to accommodate or support other components constituting the detergent supply 200 therein.

The housing 210 may be formed to have a box shape in which a rear surface 210*a* is entirely open such that the predetermined receiving space is defined therein.

The detergent container 280, which will be described later, may be mounted or removed by passing through the open rear surface 210*a*. The cover 220, which will be described later, may be coupled to the open rear surface 210*a*, and the rear surface 210*a* may be closed by the cover 220.

For example, considering a shape of the detergent container 280 and a detergent storage capacity of the detergent container 280, a width in the front and rear direction of an upper portion of the housing 210 may be much greater than a width in the front and rear direction of a lower portion thereof.

In this regard, as the lower portion of the housing 210 having the smaller width in the front and rear direction than the upper portion, a space and a support structure where the detergent pump 230, a level sensor 240, and a detachment detection sensor 260 that are electrically operated as will be described later may be attached and supported may be formed at an outer side of the rear surface 210*a* of the housing 210.

Figure 5:
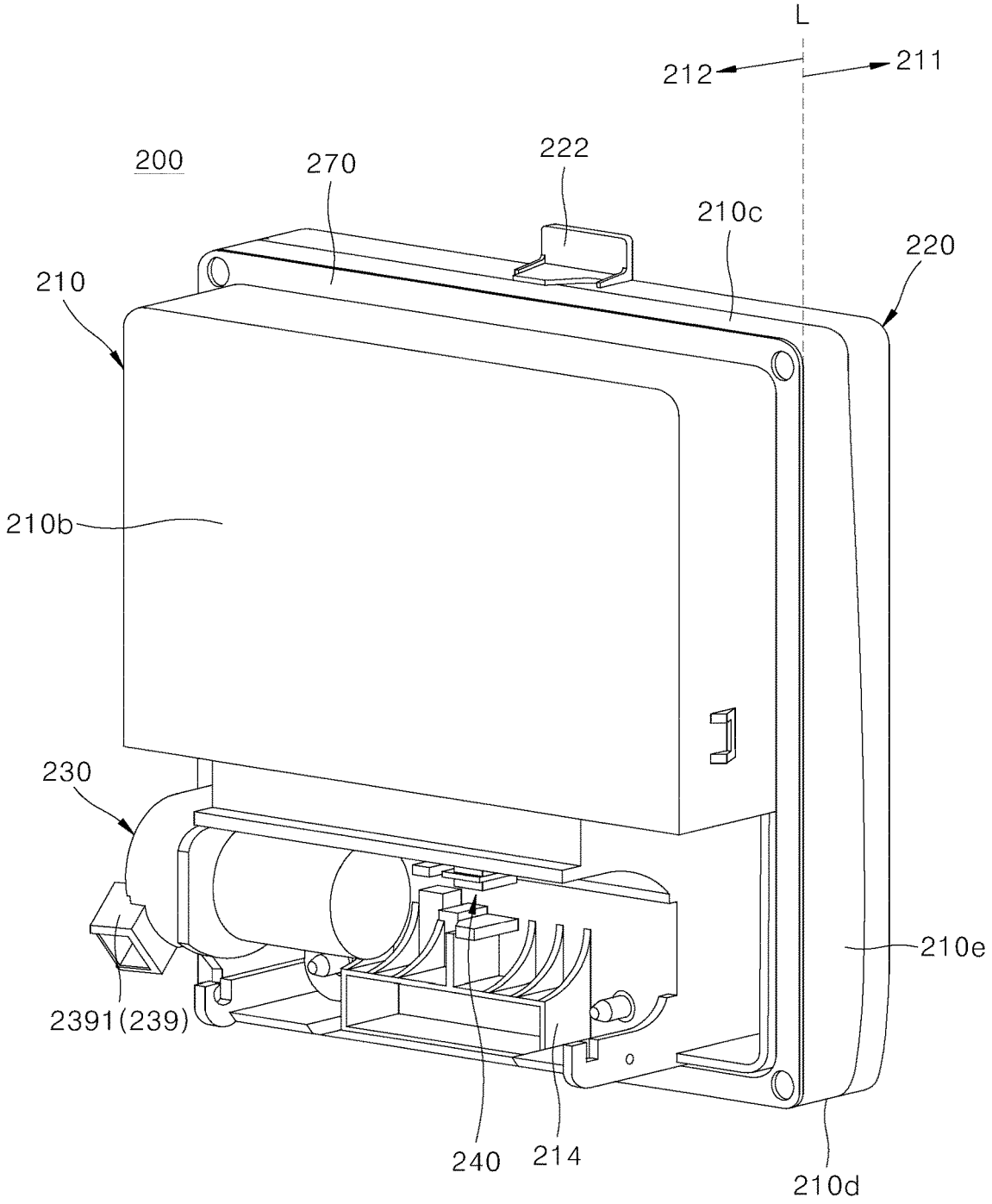

To install and support such detergent pump 230, level sensor 240, and detachment detection sensor 260, as shown in FIG. 5, a number of support ribs 214 having a predetermined shape may be formed integrally with the housing 210 at a lower portion of the rear surface 210*a* of the housing 210. In this regard, the support ribs 214 pass through the through-hole 30*b*2 of the rear panel 30*b* and are embedded inside the door 30. Therefore, considering case of assembly, the support ribs 214 may be formed so as not to extend to the outside of the housing 210 beyond both side surfaces 210*e* and 210*f* and a bottom surface 210*d* of the housing 210.

In one example, the detergent supply 200 of the dish washer 1 according to the present disclosure may be constructed to supply a single type of detergent or supply two types of detergents.

As shown, the housing 210 may be formed to have an approximately bilaterally symmetrical shape so as to be commonly used for supplying the single type of detergent and supplying the two types of detergents.

When applied to supply the two types of detergents, the housing 210, which has the bilaterally symmetrical shape, may be divided in a left and right direction (a Le-Ri direction), and a right side of the housing 210 may be used for supplying a first detergent and a left side of the housing 210 may be used for supplying a second detergent.

Figure 4:
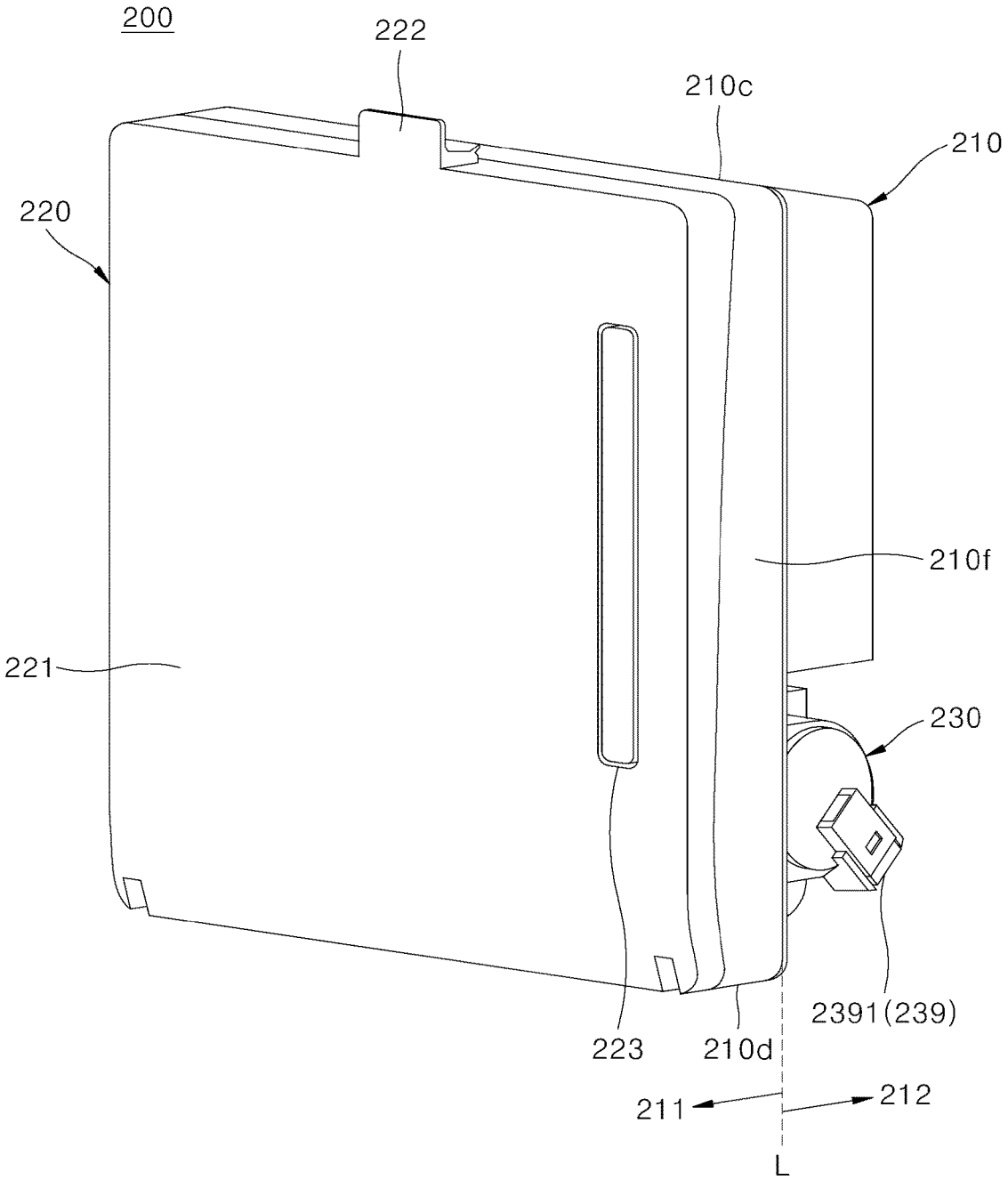
FIGS. 4 and 5 are a rear perspective view and a front perspective view showing a detergent supply with a door shown in FIGS. 3A to 3C closed.

However, in an embodiment shown in FIG. 4 and subsequent drawings, components other than the housing 210 are applied for supplying the single type of detergent. The present disclosure is not limited thereto, but a description will be made below based on the embodiment in which the housing 210 is applied to the detergent supply 200 for supplying the single type of detergent, as shown.

In one example, as described above, in the state in which the detergent supply 200 is directed in the vertical direction, the detergent supply 200 may be installed on the rear panel 30*b* of the door 30 in the state in which the portion of the housing 210 is exposed to the washing space 21 of the tub 20 and the remaining portion of the housing 210 is embedded inside the door 30.

Accordingly, the housing 210 may have a shape of being divided along a front and rear direction (a F-R direction) centered on a virtual reference line L shown in FIG. 5. A portion of the housing 210 corresponding to a rear portion with respect to the virtual reference line L may be exposed to the washing space 21 and thus may be referred to as an exposed portion 211, and a portion of the housing corresponding to a front portion with respect to the virtual reference line L may be embedded inside the door 30 and thus may be referred to as an embedded portion 212.

In this regard, when cut along a plane perpendicular to the front and rear direction (the F-R direction), a cross-sectional area of the exposed portion 211 may be greater than a cross-sectional area of the embedded portion 212.

Accordingly, a predetermined stepped surface 213 may be formed at a rear end of the embedded portion 212 and a front end of the exposed portion 211, which correspond to a boundary between the exposed portion 211 and the embedded portion 212.

The stepped surface 213 serves to increase a contact area size or a coupling area size with the rear panel 30*b* when fastened to the rear panel 30*b* of the door 30. To this end, the stepped surface 213 may be constructed to have a shape corresponding to a shape of the rear surface of the rear panel 30*b*.

In addition, fastening holes through which fastening means such as a screw bolt passes may be respectively defined at four top, bottom, left, and right corners of the stepped surface 213.

In one example, as described above, the water leak preventing means may be disposed between the detergent supply 200 and the rear panel 30*b* of the door 30 such that the electrical components of the detergent supply 200 and a number of electrical components that are disposed inside the door 30 are not affected by the washing water.

As the water leak preventing means, a gasket 270 that is interposed between the stepped surface 213 and the rear panel 30*b* of the door 30 and is made of a material having a predetermined elasticity may be disposed.

As shown in FIG. 5, the gasket 270 may be coupled to the stepped surface 213 and may be formed to have a shape corresponding to a shape of the stepped surface 213.

In more detail, the gasket 270 may be constructed to have a width corresponding to a width of the stepped surface 213, and may have a thickness sufficient to provide a predetermined elastic force.

In one example, the cover 220 is detachably connected to the housing 210 and serves to open and close the open rear surface 210*a* of the housing 210.

As an example, similar to the door 30 described above, the cover 220 may be constructed to pivot to open and close the internal receiving space of the housing 210. To this end, a cover body 221 may have a size to entirely cover the rear surface 210*a* of the housing 210.

Additionally, a lower end of the cover body 221 may be pivotably connected to the housing 210.

In one example, a fastener 222 may be disposed at an upper end of the cover body 221 as means for providing detachable coupling to the housing 210.

As an example, the fastener 222 may include a lever extending upward from the upper end of the cover body 221, and a fastening tab integrally connected to the lever and extending in the horizontal direction.

Although not shown, a locking protrusion to which the fastening tab is elastically coupled may be disposed on a top surface 210*c* close to the rear surface 210*a* of the housing 210.

Therefore, the user may easily release a locked state between a fastening protrusion and the locking protrusion by pulling the lever in the direction away from the housing 210.

In one example, a through-hole 223 that extends along the vertical direction (the U-D) and whose width in the left and right direction is maintained approximately constant may be defined in the cover body 221.

When the cover 220 is fastened to the housing 210, the through-hole 223 may be defined at a location corresponding to a transparent window 2813 of the detergent container 280, which will be described later.

Therefore, the user may easily visually check a level and a remaining amount of the detergent stored inside the detergent container 280 via the through-hole 223 of the cover 220 and the transparent window 2813 of the detergent container 280.

In one example, the detergent supply 200 may further include the detergent container 280 inside which the detergent to be supplied to the washing space 21 of the tub 20 is stored.

Figure 6:
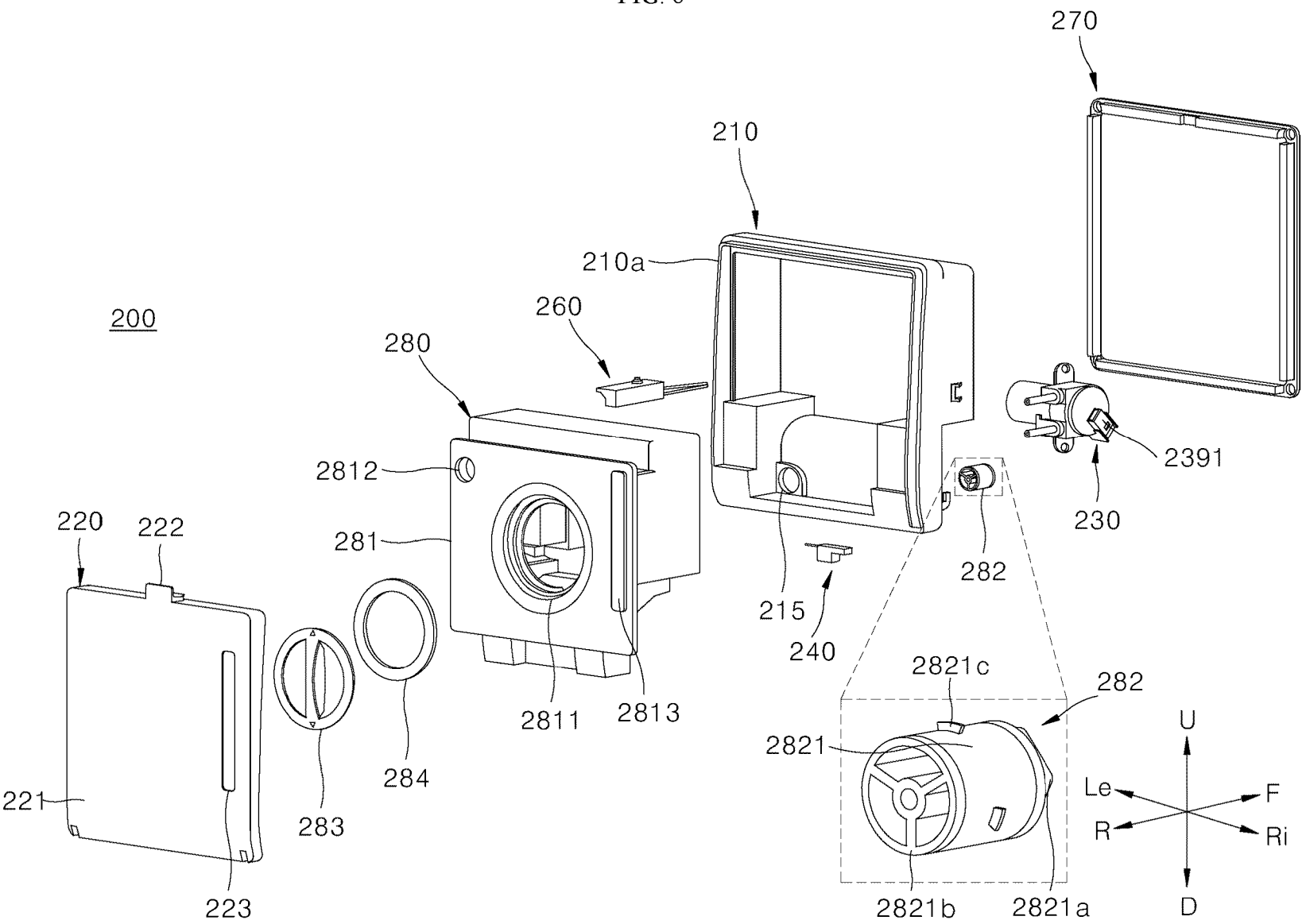
FIG. 6 is an exploded perspective view of FIG. 4.
Figure 7:
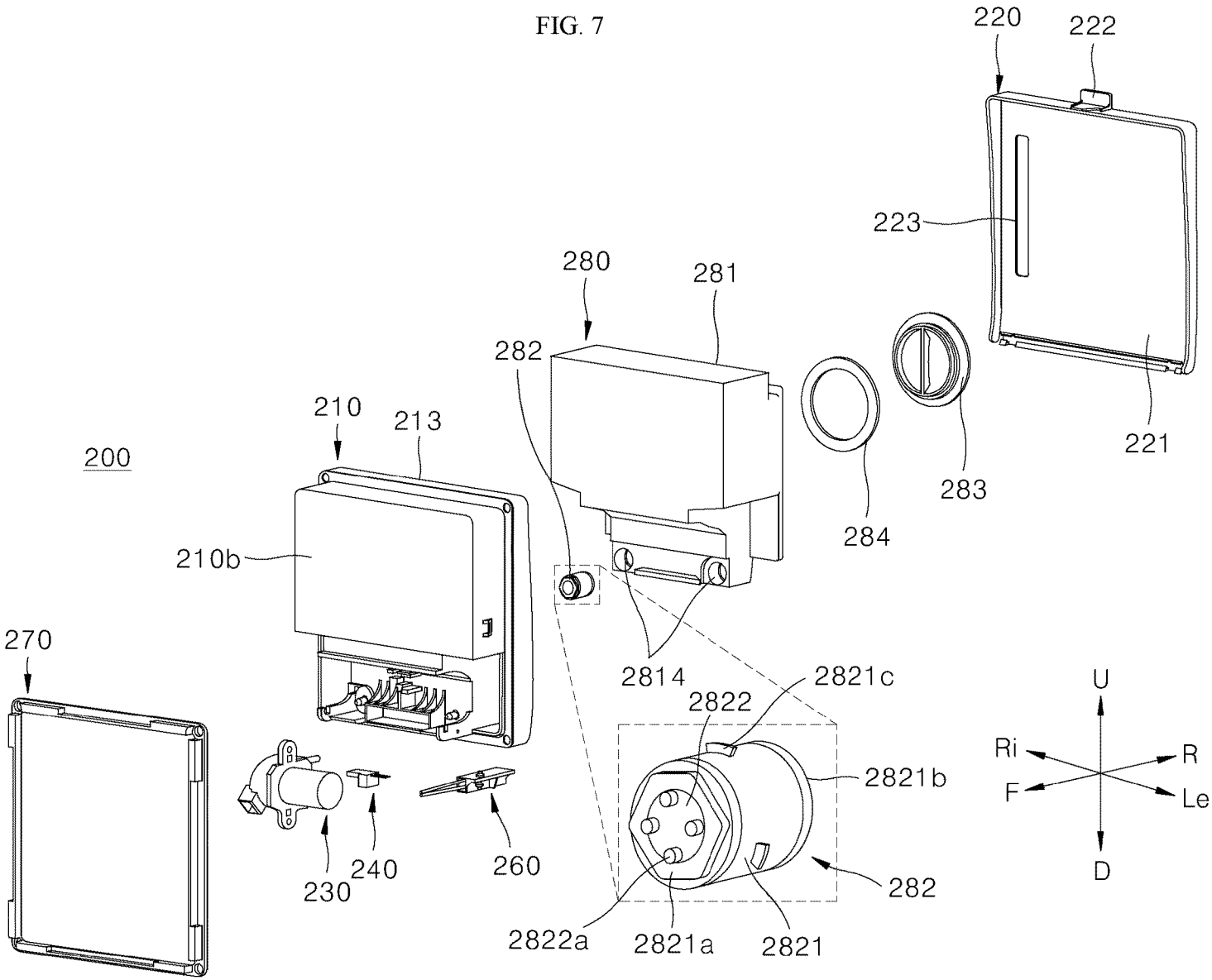
FIG. 7 is an exploded perspective view of FIG. 5.

As shown in FIGS. 6 and 7, the container body 281 of the detergent container 280 may have a container shape with a predetermined detergent storage space defined therein.

In addition, as described above, the detergent container 280 is entirely accommodated in the internal receiving space of the housing 210, so that the container body 281 may have an outer appearance corresponding to a shape of the internal receiving space of the housing 210.

An inlet 2811 for detergent replenishment may be defined at a center of a rear surface of the container body 281.

A sealing cap 283 may be detachably coupled to the inlet 2811. Therefore, the user may open the inlet 2811 by removing the sealing cap 283 from the inlet 2811 and replenish the detergent via the inlet 2811.

As shown, a sealing ring 284 made of a material with a predetermined elasticity may be added between the inlet 2811 and the sealing cap 283 to prevent leakage of the detergent.

In one example, a ventilation hole 2812 defined through the rear surface of the container body 281 may be defined at an upper end of the rear surface of the container body 281.

With the internal storage space of the container body 281 closed by the sealing cap 283, the ventilation hole 2812 is used to compensate for a phenomenon in which a pressure of the internal storage space becomes lower than an atmospheric pressure as the supply of the detergent progresses.

However, because there is a possibility that the detergent may leak via the ventilation hole 2812, detergent leak preventing means such as an air valve or a membrane may be added to the ventilation hole 2812.

As described above, the transparent window 2813 corresponding to the through-hole 223 of the cover 220 may be formed on the rear surface of the container body 281. To visually check the level and the remaining amount of the detergent stored inside the container body 281, the transparent window 2813 may be made of a transparent or translucent material capable of transmitting visible light.

In one example, as shown in FIG. 7, a detergent outlet 2814 may be formed at a lower end of a front surface of the container body 281.

The detergent outlet 2814 may be placed at the lowermost end of the container body 281 such that the detergent may easily flow by gravity.

It is shown in FIG. 7 that a pair of detergent outlets 2814 are disposed at left and right sides of the front surface of the container body 281, but this is for commonization as the detergent container 280 for supplying the two types of detergents. When the detergent container 280 for supplying the single type of detergent is used as in the present embodiment, the detergent outlet 2814 on the left may be in a closed state.

A container valve 282 may be coupled to the detergent outlet 2814. The container valve 282 closes the detergent outlet 2814 when the container body 281 is removed and separated from the housing 210, and opens the detergent outlet 2814 when the container valve 282 is mounted on the housing 210.

A valve coupling portion 215 to which the container valve 282 is coupled when the detergent container 280 is mounted may be formed inside the housing 210. When the container valve 282 is coupled to the valve coupling portion 215 of the housing 210, the container valve 282 may open at the same time as the coupling, and the detergent outlet 2814 may open.

As shown in partially enlarged views in FIGS. 6 and 7, the container valve 282 may be composed of a valve body 2821 in which a front end 2821*a* and a rear end 2821*b* are at least partially open, a plug 2822 that is movably disposed in the front and rear direction inside the valve body 2821 and opens and closes an open portion of the front end 2821*a* of the valve body 2821, and a spring (not shown) that provides a restoring force to the plug 2822.

As shown, the valve body 2821 may have a cylindrical outer appearance, and an internal passage through which the detergent flows may be defined therein.

The internal passage is in communication with the open portion formed at the front end 2821*a* of the valve body 2821 and an open portion formed at the rear end 2821*b*.

The rear end 2821*b* of the valve body 2821 may be firmly coupled to the detergent outlet 2814 of the container body 281. Therefore, the detergent supplied from the container body 281 may be introduced via the open portion of the rear end 2821*b* of the valve body 2821 and may flow along the internal passage of the valve body 2821.

The front end 2821*a* of the valve body 2821 may be coupled to the valve coupling portion 215 (see FIG. 12) of the housing 210.

Therefore, the detergent flowing along the internal passage of the valve body 2821 may be discharged via the open portion of the front end 2821*a* of the valve body 2821 and may be supplied to the valve coupling portion 215 of the housing 210.

The plug 2822 is disposed inside the valve body 2821 and serves to open and close the open portion of the front end 2821*a* of the valve body 2821.

Therefore, the plug 2822 may have a shape corresponding to the open portion of the front end 2821*a* of the valve body 2821.

The plug 2822 is pressed in a direction to close the open portion of the front end 2821*a* of the valve body 2821 by the spring (not shown).

In one example, at least one contact protrusion 2822*a* that protrudes in a direction away from the valve body 2821 may be integrally formed with a front end surface of the plug 2822.

The contact protrusion 2822*a* may be formed to protrude farther from the container body 281 than the front end surface of the plug 2822 and the front end 2821*a* of the valve body 2821.

Therefore, when the container body 281 is mounted on the housing 210, the contact protrusion 2822*a* of the plug 2822 first comes into contact with an end surface of the valve coupling portion 215.

Additional movement of the plug 2822 may be blocked by the contact between the contact protrusion 2822*a* and the valve coupling portion 215.

Therefore, when the container body 281 continues to be mounted on the housing 210, a relative movement of the front end 2821*a* of the valve body 2821 may continue while the movement of the plug 2822 is blocked.

As the relative movement of the valve body 2821 with respect to the plug 2822 progresses, a gap may occur between the plug 2822 and the open portion of the front end 2821*a* of the valve body 2821, and the gap may gradually expand. As such a gap is defined, the container valve 282 may be switched from a closed state to an open state.

With such a gap, the detergent may flow from the container valve 282 to the valve coupling portion 215, and the detergent may be supplied from the container body 281.

In one example, when the container body 281 is removed from the housing 210, the contact protrusion 2822*a* of the plug 2822 may be removed from the end surface of the valve coupling portion 215. In this case, the gap between the plug 2822 and the open portion of the front end 2821*a* of the valve body 2821 may be immediately released by the restoring force of the spring described above, and the valve body 2821 may return to the closed state.

In one example, as shown, at least one stopper 2821*c* for determining an insertion depth and an insertion location with respect to the detergent outlet 2814 of the container body 281 may be integrally formed on an outer circumferential surface of the valve body 2821.

In addition, as shown, the sealing ring for preventing the leakage of the detergent between an inner circumferential surface of the valve coupling portion 215 and the valve body 2821 may be further disposed at a side of the front end 2821*a* of the valve body 2821.

However, such a configuration of the container valve 282 is merely illustrative. As long as means is in the closed state when removed from the housing 210 and is switched to the open state when mounted on the housing 210, the means may be applied to the present disclosure without limitation.

In one example, the detachment detection sensor 260 may be attached to the housing 210 as means to detect the state in which the detergent container 280 is mounted on or removed from the housing 210.

As described above, the detachment detection sensor 260 may be disposed in the embedded portion 212 of the housing 210 so as not to be affected by the washing water, and as shown by way of example, may be attached at a location below the front surface 210*b* of the housing 210 and close to a left side surface.

As an example, the detachment detection sensor 260 may be of a hall sensor type that detects a magnetic force.

Correspondingly, the container body 281 may have a magnetic body (not shown) that emits a predetermined magnetic force at a location corresponding to the location of the detachment detection sensor 260 when the detergent container 280 is mounted on the housing 210.

The detachment detection sensor 260 may be electrically connected to a controller 100, which will be described later, and an output signal of the detachment detection sensor 260 may be transmitted to the controller 100. The controller 100 may easily identify whether the detergent container 280 is mounted on the housing 210 or is removed from the housing 210 via the received output signal of the detachment detection sensor 260.

Additionally, the level sensor 240 may be attached to the housing 210 as means to check the remaining amount of the detergent stored inside the container body 281.

Like the detachment detection sensor 260, the level sensor 240 may be disposed in the embedded portion 212 of the housing 210 so as not to be affected by the washing water, and as shown by way of example, may be located below the front surface of the housing 210 and at a center of the housing 210.

Similar to the detachment detection sensor 260, the level sensor 240 may be formed as the hall sensor that detects the magnetic force.

Correspondingly, a floater (not shown) that may move in the vertical direction (the U-D) based on a level of the detergent may be disposed inside the container body 281.

A magnetic body that emits a predetermined magnetic force may be attached to the floater, and the detachment detection sensor 260 may generate the output signal corresponding to an intensity of the magnetic force emitted from the magnetic body of the floater.

Similar to the detachment detection sensor 260, the level sensor 240 may be electrically connected to the controller 100, which will be described later, and an output signal of the level sensor 240 may be transmitted to the controller 100. The controller 100 may easily identify the remaining amount of the detergent stored inside the container body 281 via the received output signal of the level sensor 240.

In one example, the detergent supply 200 may further include the detergent pump 230 for providing the detergent stored in the detergent container 280 to the washing space 21 of the tub 20.

In the present embodiment, the detergent pump 230 may be formed as a tube pump operated by the electric motor to facilitate control of a detergent supply amount.

As known in the art, the tube pump may be constructed to pump the detergent in a scheme of pressurizing a flexible tube with a detergent flow passage defined therein via at least one roller to push the detergent and allow the detergent to flow.

The embodiment shown in FIGS. 4 to 7 shows the configuration with the single detergent pump 230 for supplying the single type of detergent, but when applied for supplying the two types of detergents, the detergent pump 230 having the same specifications may be additionally disposed.

Similar to the detachment detection sensor 260 and the level sensor 240 described above, the detergent pump 230 that is electrically operated may be disposed in the embedded portion 212 of the housing 210 so as not to be affected by the washing water, and as an example, the detergent pump 230 may be installed on and fixed to the support rib 214 formed below the front surface of the housing 210.

In one example, a roller sensor 2391 that senses a location of a roller 233, which pressurizes a tube 232 to allow the detergent to flow, and generates an output signal corresponding to the location of the roller 233 may be attached to the detergent pump 230.

The roller sensor 2391 may be electrically connected to the controller 100, which will be described later, and the output signal of the roller sensor 2391 may be transmitted to the controller 100. The controller 100 may calculate the number of revolutions of the roller 233 via the received output signal of the roller sensor 2391, and may easily determine the detergent supply amount accordingly.

A configuration related to a method for determining the detergent supply amount using the roller sensor 2391 will be described later with reference to FIG. 21 and subsequent drawings.

[Detailed Configuration of Detergent Pump]

Hereinafter, with reference to FIGS. 8 to 20, a detailed configuration of the detergent pump 230 disposed in the detergent supply 200 of the dish washer 1 according to one embodiment of the present disclosure will be described.

Figure 8:
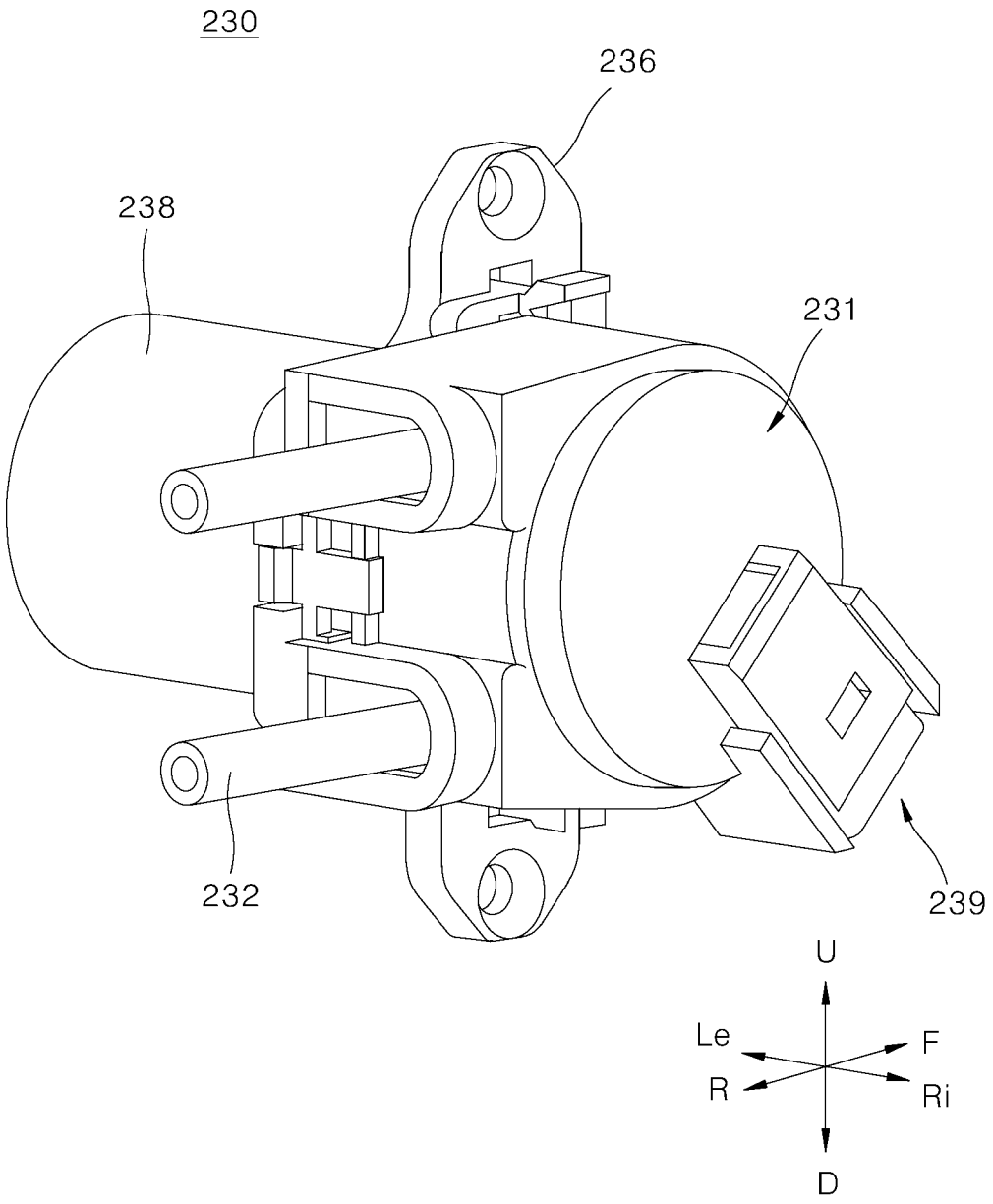
FIG. 8 is a rear perspective view of a detergent pump shown in FIG. 6.
Figure 9:
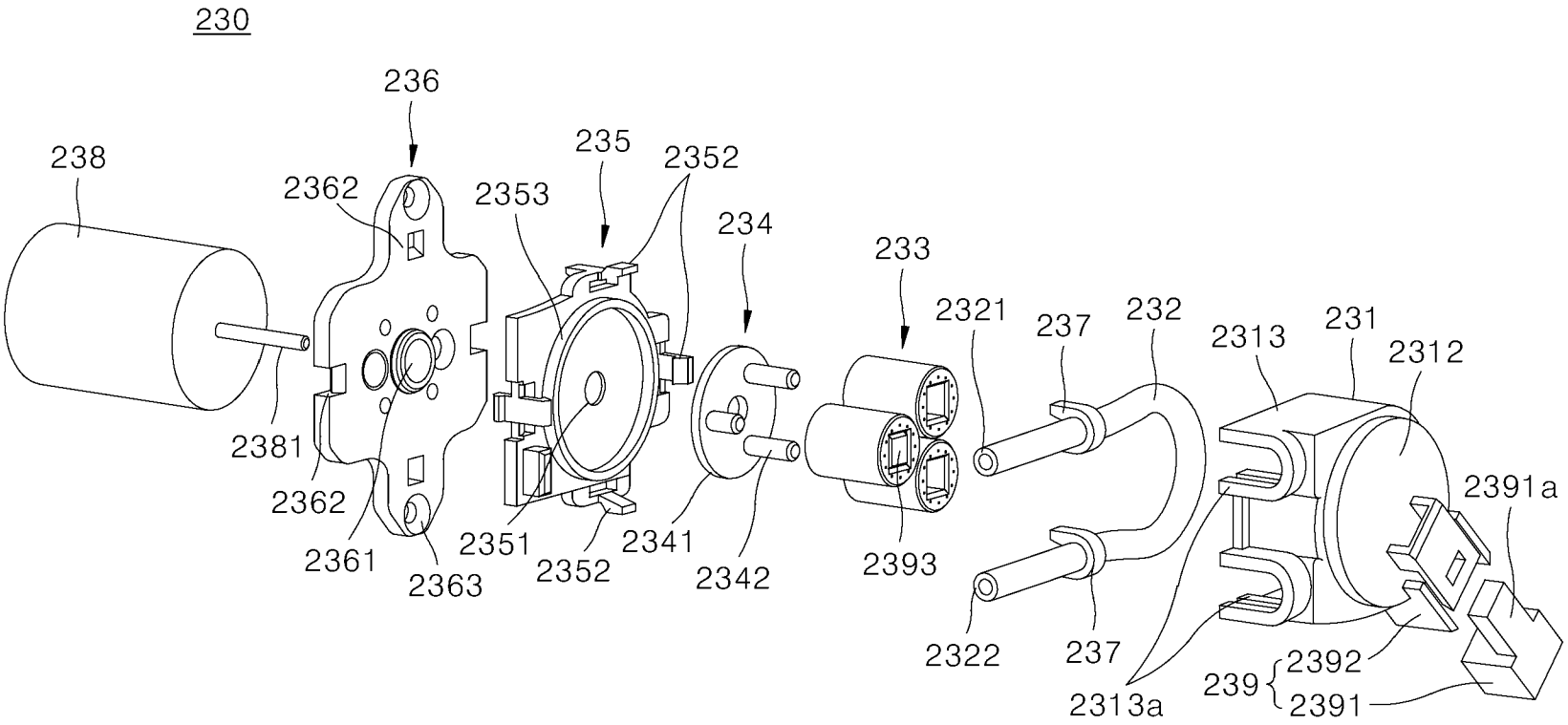
FIGS. 9 and 10 are a rear exploded perspective view and a front exploded perspective view of FIG. 8.
Figure 10:
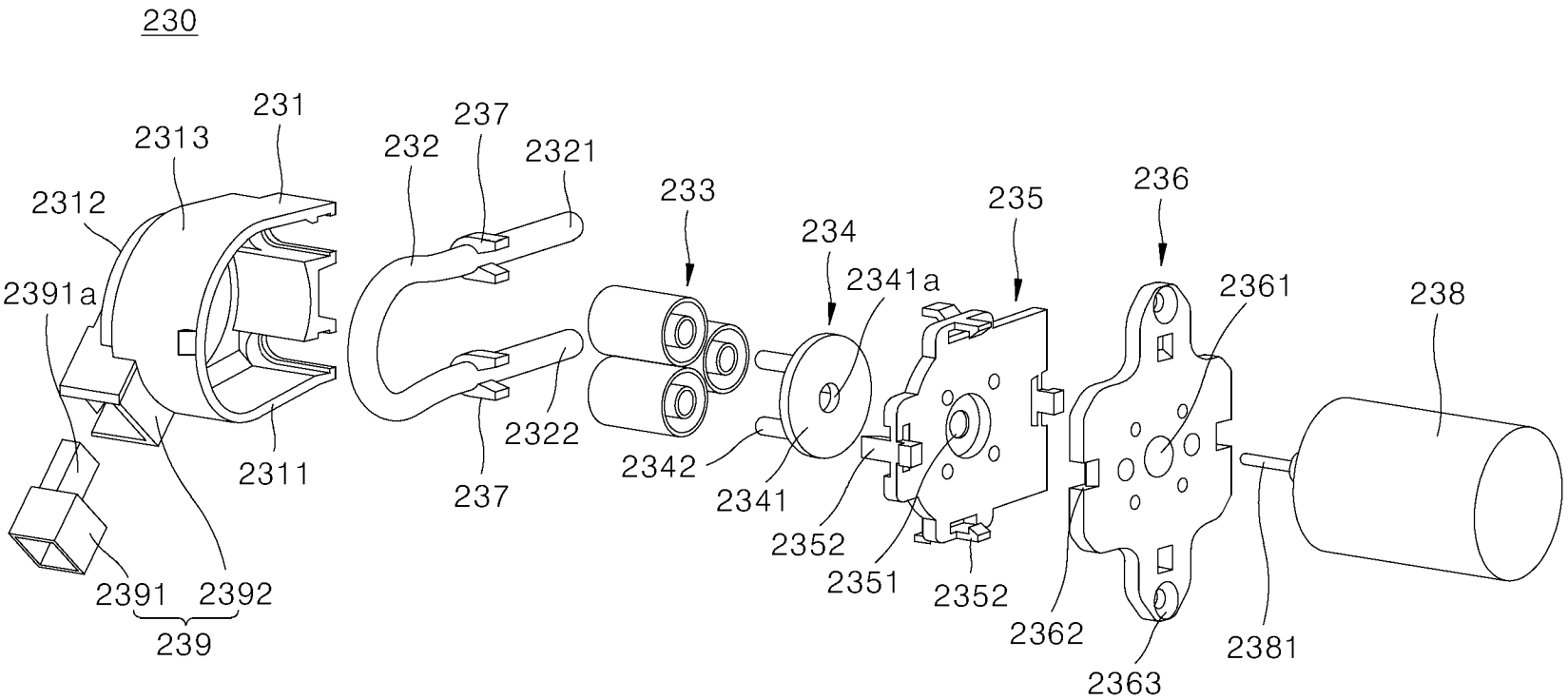

First, referring to FIGS. 8 to 10, the detergent pump 230 may be composed of a pump casing 231 that accommodates the roller 233 and the tube 232 therein, the tube 232 in which the detergent passage is defined, the roller 233 that allows the detergent to flow by pressurizing the tube 232, a carrier 234 that supports the roller 233 such that the roller 233 is able to revolve and spin, a cover plate 235 coupled to the pump casing 231, a base plate 236 with one side surface to which the cover plate 235 is coupled, and a pump motor 238 that provides a driving force for the roller 233 to revolve and spin.

The pump casing 231 serves to accommodate and protect the roller 233 and the tube 232, which will be described later, therein.

To this end, a first end surface 2311 of the pump casing 231 in a direction of a revolution axis Xc of the roller 233 may be entirely opened, and a second end surface 2312 in the direction of the revolution axis Xc may be entirely closed.

A circumferential surface 2313 may be formed between the first end surface 2311 and the second end surface 2312, and a pair of slots 2313*a* may be defined through the circumferential surface 2313 such that the tub may pass therethrough.

As will be described later, the tube 232 is maintained in a state of being bent in a C-shape inside the pump casing 231.

To this end, a portion of an inner surface of the circumferential surface 2313 of the pump casing 231 may have a semi-cylindrical shape. In other words, the inner surface of the circumferential surface 2313 may act as a support surface that maintains the state of the tube 232 of being bent in the C-shape while the tube 232 is pressurized by the roller 233.

The tube 232 functions as the detergent passage through which the detergent supplied from the detergent container 280 described above flows.

Additionally, the tube 232 may be made of a flexible material such that the detergent filling the internal passage of the tube 232 is pumped by the roller 233.

Therefore, when the tube 232 is pressurized while sandwiched between an outer circumferential surface of the roller 233 and the circumferential surface 2313 of the pump casing 231, the tube 232 may be easily deformed such that the internal passage is blocked by a pressing force, and when the pressing force of the roller 233 is released, the tube 232 may be effectively restored to an original shape thereof.

In this regard, because the roller 233 moves while revolving, a location of the tube 232 pressurized by the roller 233 changes depending on the revolution of the roller 233.

Accordingly, the detergent filling the internal passage of the tube 232 flows together with the revolution of the roller 233.

The tube 232 may be partially accommodated inside the pump casing 231, and a first end 2321 that acts as an inlet through which the detergent is introduced and a second end 2322 through which the detergent is pumped and discharged of the tube 232 may pass through the pair of slots 2313*a* of the pump casing 231, respectively, and extend to the outside of the pump casing 231.

Portions where the tube 232 passes through the pair of slots 2313*a* may be firmly fixed to the pair of slots 2313*a* by a pair of tube clips 237, respectively.

In one example, the first end 2321 of the tube 232, which acts as the inlet, may be connected to and in communication with the detergent outlet 2814 of the detergent container 280, and the second end 2322 of the tube 232, which acts as an outlet, may be connected to and in communication with a discharge hole 218 that ultimately discharges the pumped detergent toward the tub 20.

Figure 11A:
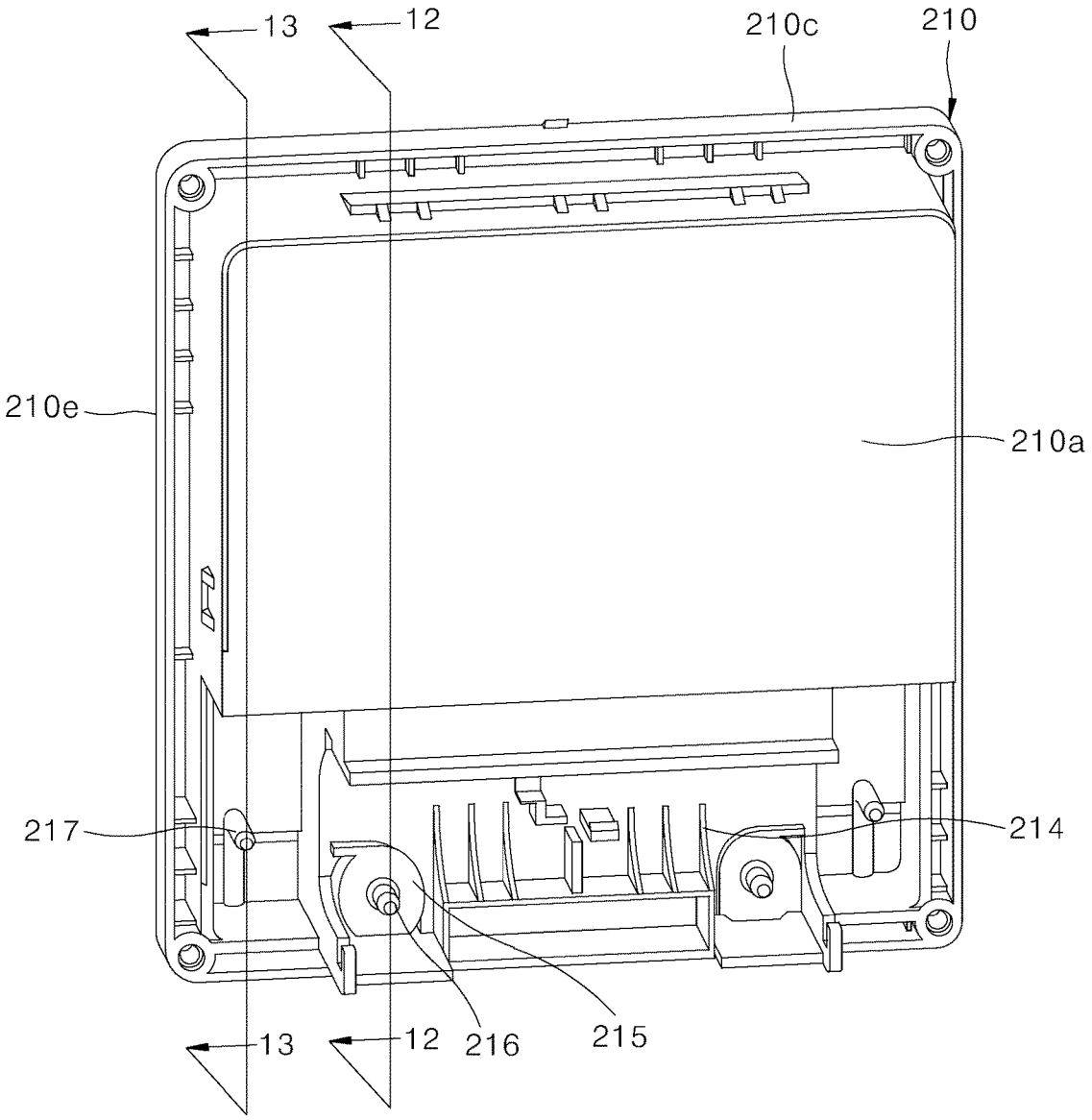
FIG. 11A is a front perspective view of a housing shown in FIGS. 6 and 7, and FIGS. 11B and 11C are partial enlarged views of a housing shown in FIGS. 6 and 7.
Figure 11B:
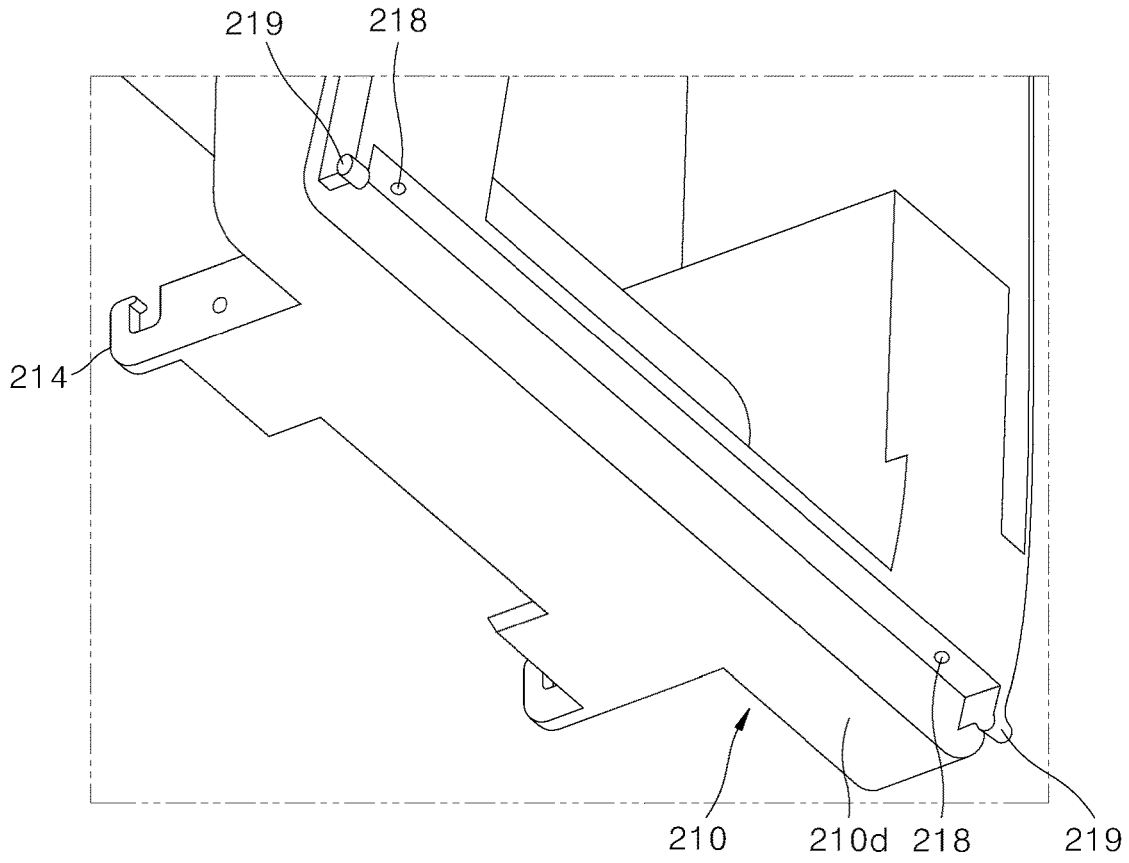

As shown in FIG. 11B, the discharge hole 218 may be defined in the exposed portion 211 of the housing 210, and preferably, may be defined as close as possible to the open rear surface 210*a* of the housing 210.

Therefore, the discharge hole 218 may be defined at a location spaced as far as possible from the reference line L toward the inside of the tub 20, and accordingly, the detergent discharged from the discharge hole 218 may fall freely by gravity toward a bottom surface 25 of the tub 20.

In addition, the discharge hole 218 may be defined in a stepped surface that is located below the open rear surface 210*b* of the housing and located upwardly of the bottom surface 210*d* of the housing 210 in the vertical direction.

Figure 11C:
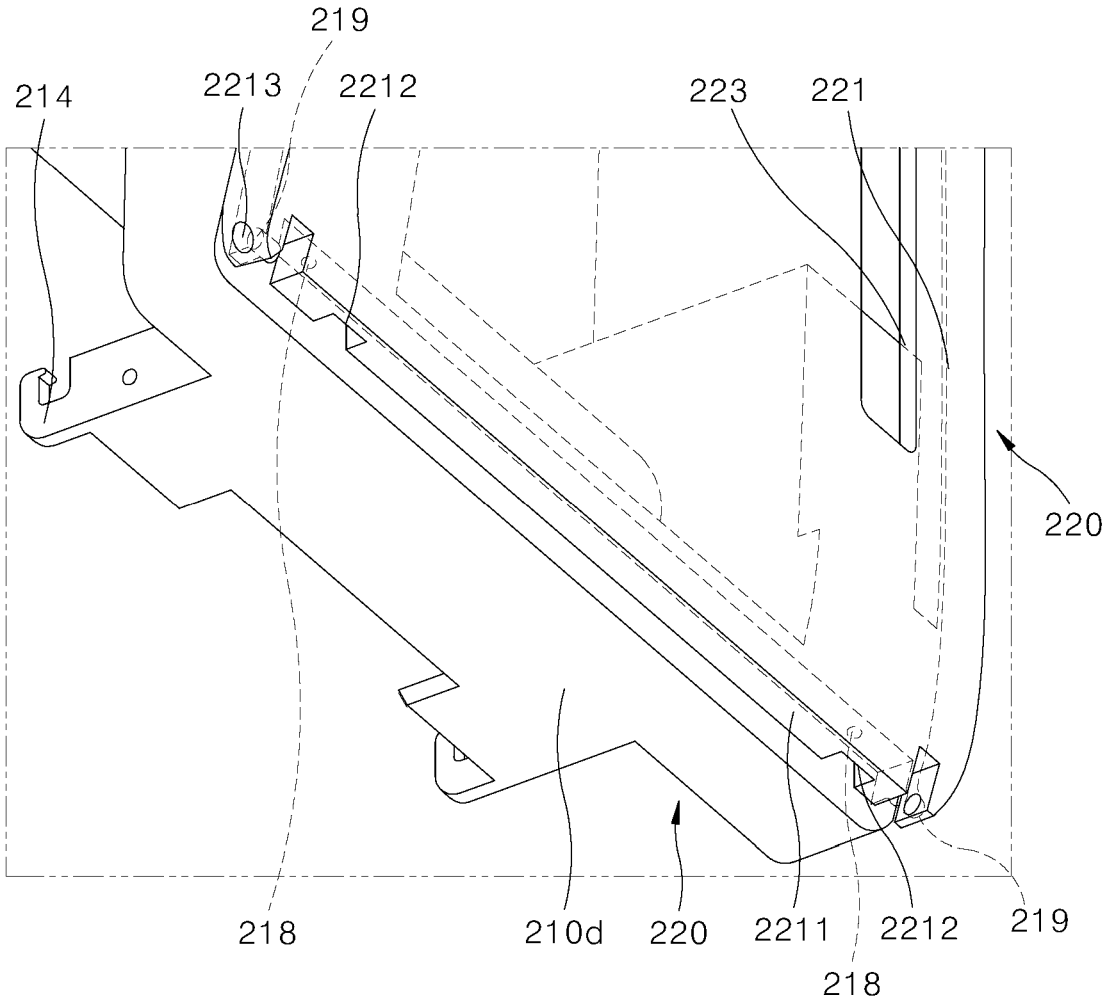

Additionally, as shown in FIG. 11C, when the cover 220 is coupled to the housing 210 and viewed from the rear, the discharge hole 218 is covered by the cover 220.

Accordingly, the discharge hole 218 may be defined upwardly of the bottom surface 210*d* of the housing 210 in the vertical direction, and may be maintained covered by the cover 220. Accordingly, the washing water scattering during the operation of the dish washer 1 may be effectively prevented from directly reaching the discharge hole 218 or from being introduced via the discharge hole 218.

In one example, the discharge hole 218 may be covered by the cover 220, but as shown in FIG. 11C, a notch-shaped groove 2212 may be defined at a lower end 2211 of the cover 220 such that the flow of the detergent discharged from the discharge hole 218 by gravity is not interfered.

However, an area size of the groove 2212 defined at the lower end of the cover 220 may be greater than a cross-sectional area of the discharge hole 218 such that the detergent may flow effectively.

In one example, each hinge hole 2213 into which a hinge shaft 219 of the housing 210 is inserted may be defined through the lower end of the cover 220 on a left or right side of each groove 2212. The cover 220 may be pivotably supported with respect to the housing 210 with the hinge shaft 219 inserted into the hinge holes 2213.

As shown in FIGS. 11A to 13, the housing 210 may have a first nipple 216 as an intermediate connection medium that connects the first end 2321 of the tube 232 with the valve coupling portion 215, and a second nipple 217 as an intermediate connection medium that connects the second end 2322 of the tube 232 with the discharge hole 218.

As shown, the first nipple 216 and the second nipple 217 may be formed integrally with the lower portion of the front surface of the housing 210 where the support rib 214 is disposed.

As described above, a pair of first nipples 216 and a pair of second nipples 217 may be formed at locations that are approximately symmetrical with respect to the housing 210 such that the detergent supply 200 is commonly used for supplying the single type of detergent and for supplying the two types of detergents.

When applied for supplying the single type of detergent, the detergent may flow only to the first nipple 216 and the second nipple 217 disposed at a left side of the housing 210, as shown. Hereinafter, a description will be made based on the first nipple 216 and the second nipple 217 disposed at the left side of the housing 210.

Passages through which the detergent may flow may be defined inside the first nipple 216 and the second nipple 217, respectively.

Figure 12:
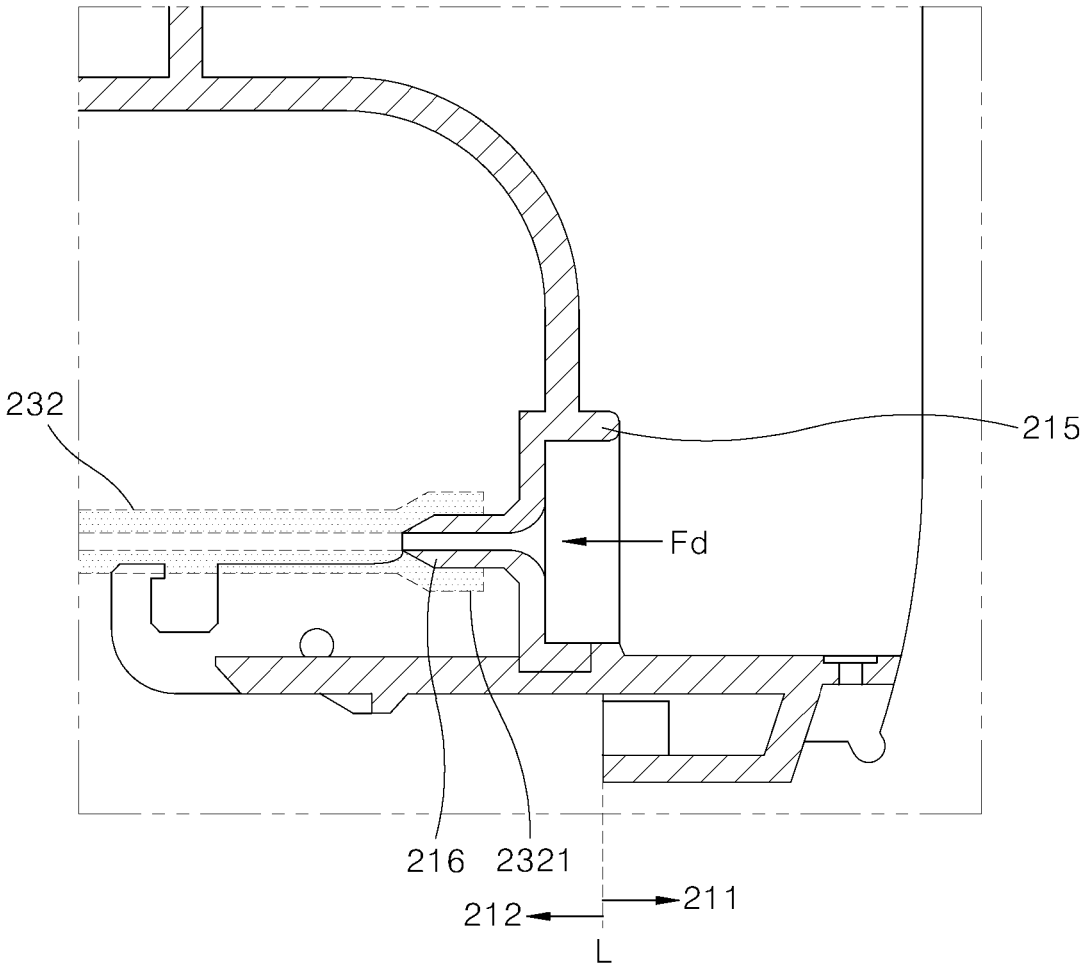
FIG. 12 is a cross-sectional view of a housing shown in FIG. 11A taken along a line 1-1.

As shown in FIG. 12, the first nipple 216 may be inserted into the first end 2321 of the tube 232 and connected to the first end 2321.

Figure 13:
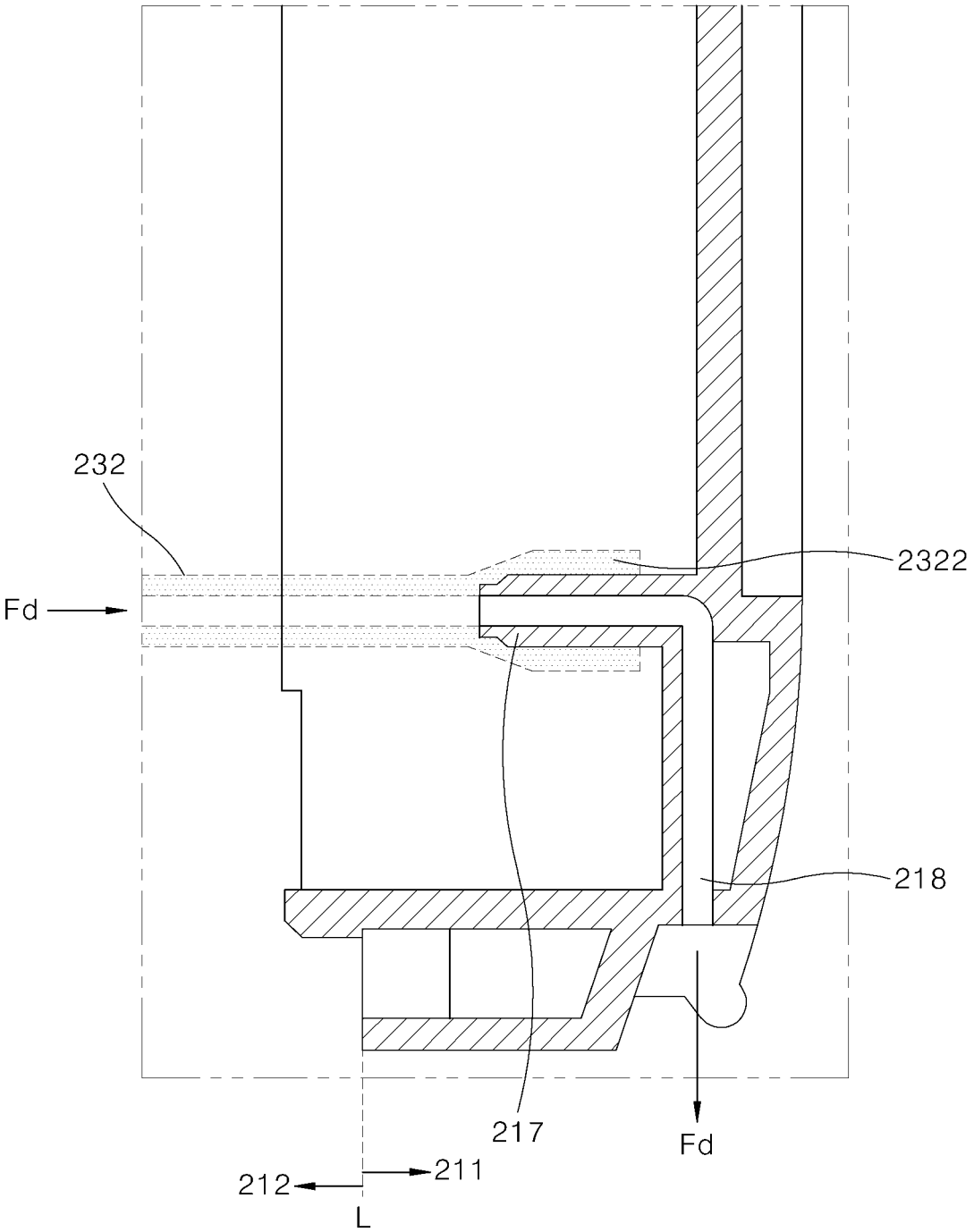
FIG. 13 is a cross-sectional view of a housing shown in FIG. 16 taken along a line 2-2.

Additionally, as shown in FIG. 13, the second nipple 217 may be inserted into the second end 2322 of the tube 232 and connected to the second end 2322.

As such, when the connection between the first end 2321 of the tube 232 and the first nipple 216 and the connection between the second end 2322 of the tube 232 and the second nipple 217 are completed, a continuous detergent flow path Fd may be defined inside the first nipple 216, the tube 232, and the second nipple 217.

As an example, the first nipple 216 may have a shape that extends linearly along the horizontal direction, and the second nipple 217 may have an L-shape to divert the detergent flow path Fd from the horizontal direction to the vertical direction toward the discharge hole 218.

The roller 233 serves to pump the detergent by pressurizing the tube 232 and allowing the detergent to flow along the internal passage of the tube 232 while revolving along the revolution axis Xc, which is a revolution axis.

The illustrated embodiment shows a configuration in which a total of three rollers 233 are disposed inside the pump casing 231.

The present disclosure is not limited thereto, but a following description will be made based on the embodiment with the three rollers 233.

For convenience, to distinguish the three rollers 233, the rollers will be referred to as a first roller 2331, a second roller 2332, and a third roller 2333.

However, such first roller 2331, second roller 2332, and third roller 2333 may have the same shape and size as will be described later, and may be interchangeable with each other.

A detailed configuration of the first roller 2331, the second roller 2332, and the third roller 2333 will be described later with reference to FIG. 14 and subsequent drawings.

The carrier 234 serves to support the first roller 2331, the second roller 2332, and the third roller 2333 so as to be able to spin and revolve.

In more detail, the carrier 234 may include a disc-shaped plate 2341 and multiple roller support shafts 2342 extending from the disc-shaped plate 2341 toward the roller 233.

The disc-shaped plate 2341 may be supported by the cover plate 235 with one side surface thereof in surface contact with the cover plate 235, which will be described later.

In addition, the disc-shaped plate 2341 may be rotatably supported, preferably, supported so as to be able to spin with respect to the cover plate 235.

As will be described later, a ring-shaped guide rib 2353 that is disposed in a form of surrounding the disc-shaped plate 2341 may be formed integrally with one surface of the cover plate 235 with which the disc-shaped plate 2341 comes into contact.

The disc-shaped plate 2341 may be effectively prevented from being deviated outward in a radial direction, via the ring-shaped guide rib 2353.

On the other side surface of the disc-shaped plate 2341, multiple roller support shafts 2342 that protrude toward the first roller 2331, the second roller 2332, and the third roller 2333, respectively, may be formed integrally.

More specifically, the multiple roller support shafts 2342 may be composed of a first shaft 2342*a* that rotatably supports the first roller 2331, a second shaft 2342*b* that rotatably supports the second roller 2332, and a third shaft 2342*c* that rotatably supports the third roller 2333.

Such first shaft 2342*a*, second shaft 2342*b*, and the third shaft 2342*c* act as spin axes of the first roller 2331, the second roller 2332, and the third roller 2333, respectively.

As will be described later, the first shaft 2342*a* to which the first roller 2331 is coupled may have a smaller protruding length than the second shaft 2342*b* and the third shaft 2342*c*. A detailed configuration regarding this will be described later with reference to FIG. 14 and subsequent drawings.

In one example, a circular through-hole 2341*a* may be defined at a center of the disc-shaped plate 2341 through one side surface and the other side surface. An output shaft 2381 of the pump motor 238, which will be described later, may extend through the through-hole 2341*a*.

As described later, the output shaft 2381 simultaneously come into contact with outer circumferential surfaces 2331*a*, 2332*a*, and 2333*a* of the first roller 2331, the second roller 2332, and the third roller 2333 to transmit driving forces to rotate the first roller 2331, the second roller 2332, and the third roller 2333, respectively.

In this regard, the output shaft 2381 may pass through the through-hole 2341*a* of the disc-shaped plate 2341, but may not be in contact with the disc-shaped plate 2341.

In other words, the carrier 234 may be supported and accommodated in an idle state by the pump casing 231 and the cover plate 235 in a state in which a rotational driving force is not transmitted by the output shaft 2381.

The cover plate 235 is coupled to the open first end surface 2311 of the pump casing 231 and serves to close an internal space of the pump casing 231.

As the cover plate 235 is fastened to the pump casing 231, the roller 233, the tube 232, and the carrier 234 may be restricted in a movement in the direction of the revolution axis Xc thereof while being accommodated inside the pump casing 231 by the pump casing 231 and the cover plate 235.

Similar to the carrier 234, a through-hole 2351 through which the output shaft 2381 of the pump motor 238 extends may be defined at a center of the cover plate 235.

As described above, the ring-shaped guide rib 2353 may be integrally formed on one surface of the cover plate 235 with which the disc-shaped plate 2341 comes into contact.

The ring-shaped guide rib 2353 may be formed to be concentric with the through-hole 2351, and a protrusion height thereof may be maintained approximately constant along a circumferential direction.

The ring-shaped guide rib 2353 has a purpose of preventing the disc-shaped plate 2341 from being deviated outward in the radial direction.

However, an inner diameter of the ring-shaped guide rib 2353 may be greater than an outer diameter of the disc-shaped plate 2341 so as not to interfere with the spin movement of the disc-shaped plate 2341 by contact.

Means to be fastened with the pump casing 231 may be disposed at each edge of the cover plate 235.

By way of example, the fastening means may be disposed at locations spaced apart from each other and may be formed at four locations.

In this regard, each of these fastening means may be constructed to act as fastening means for the pump casing 231, and at the same time, to act as fastening means for the base plate 236, which will be described later.

That is, each fastening means may constitute a common fastener 2352 with one side that may be fastened to the pump casing 231 and the other side that may be fastened to the base plate 236.

As the fastening means is commonized as such, the structure of the detergent pump may be simplified and a manufacturing cost may be reduced.

The base plate 236 is constructed such that the pump motor 238 is coupled to one side surface thereof and the cover plate 235 described above is coupled to the other side surface thereof, and serves to connect the pump motor 238 and the cover plate 235 to each other so as to be fixed to the housing 210.

As shown in FIGS. 9 and 10, the base plate 236 may have locking portions 2362 to which the common fasteners 2352 of the cover plate 235 may be fastened at four locations.

Further, similar to the through-hole 2351 of the cover plate 235, a through-hole 2361 through which the output shaft 2381 of the pump motor 238 extends may be defined at a center of the base plate 236.

In addition, for fastening to the support rib 214 of the housing 210, the base plate 236 may have a pair of connection tabs 2363 extending in a direction away from the central through-hole 2361. The connection tab 2363 may have a bolt hole defined therein through which fixing means such as a screw bolt may pass.

The pump motor 238 serves to generate the rotational driving force to allow the first roller 2331 to the third roller 2333 to spin and revolve.

There is no limit to a type of motor that may be applied, but considering limitations of a space where the detergent pump 230 is disposed, it is preferable to use a small electric motor.

In one example, the detergent pump 230 disposed in the detergent supply 200 of the dish washer 1 according to one embodiment of the present disclosure may further include a roller location sensor 239 for sensing a location change of the roller 233.

As mentioned above, the present disclosure is to sense the change in the location of the roller 233 while the detergent pump 230 operates, calculate the number of revolutions of the roller 233 accordingly, and determine the supply amount of the detergent.

As means to achieve such a purpose, the detergent pump 230 may further include the roller location sensor 239 as means for sensing the location of the roller 233.

As an example, the roller location sensor 239 may include the roller sensor 2391.

The hall sensor scheme may be applied to the roller sensor 2391 in the same manner as the detachment detection sensor 260 and the level sensor 240 described above.

To sense the change in the location of the roller 233, at least one of the first roller 2331 to the third roller 2333 may have a magnetic body that emits a predetermined magnetic force.

In this regard, to maintain maximum sensing performance, a sensing surface 2391*a* of the roller sensor 2391 may be disposed as close as possible to the magnetic body along the direction of the revolution axis Xc.

A correlation between the roller sensor 2391 and the roller 233 with the magnetic body will be described later with reference to FIGS. 19 and 20.

In one example, to minimize a volume of the magnetic body disposed in the roller 233 and minimize influence of the magnetic force generated by the pump motor 238, it is preferable that the roller sensor 2391 is disposed at a location the closest to the roller 233 and furthest from the pump motor 238.

Such location may be the second end surface 2312 of the pump casing 231.

Therefore, based on the roller 233, the pump motor 238 and the roller sensor 2391 may be arranged at locations spaced apart from each other along the direction of the revolution axis Xc with the roller 233 interposed therebetween.

A sensor holder 2392 that may detachably support the roller sensor 2391 may be integrally formed with the second end surface 2312 of the pump casing 231.

It is preferable that the sensor holder 2392 is disposed at a location where interference with the roller 233 that spins and revolves inside the pump casing 231 does not occur.

To this end, the sensor holder 2392 may be formed on an outer side of the second end surface 2312 of the pump casing 231 to protrude from the second end surface 2312 in a direction away from the roller 233 along a direction parallel to the revolution axis Xc.

Hereinabove, the configuration of the detergent pump 230 applied for supplying the single type of detergent has been described. However, when the detergent supply 200 according to the present disclosure is applied for supplying the two types of detergents, the detergent pump 230 that has the same configuration as described above may be additionally disposed. However, the additional detergent pump 230 may be installed at a location to be symmetrical to the existing detergent pump 230 with respect to the housing 210.

[Detailed Structure of Roller and Arrangement Structure of Magnetic Body]

Hereinafter, a detailed structure of the roller 233 disposed in the detergent pump 230 and an arrangement structure of the magnetic body will be described with reference to FIGS. 14 to 18.

As described above, in the present embodiment, the roller 233 may include the first roller 2331, the second roller 2332, and the third roller 2333 that have the same outer appearance and size and are arranged so as to be interchangeable with each other.

Figure 14:
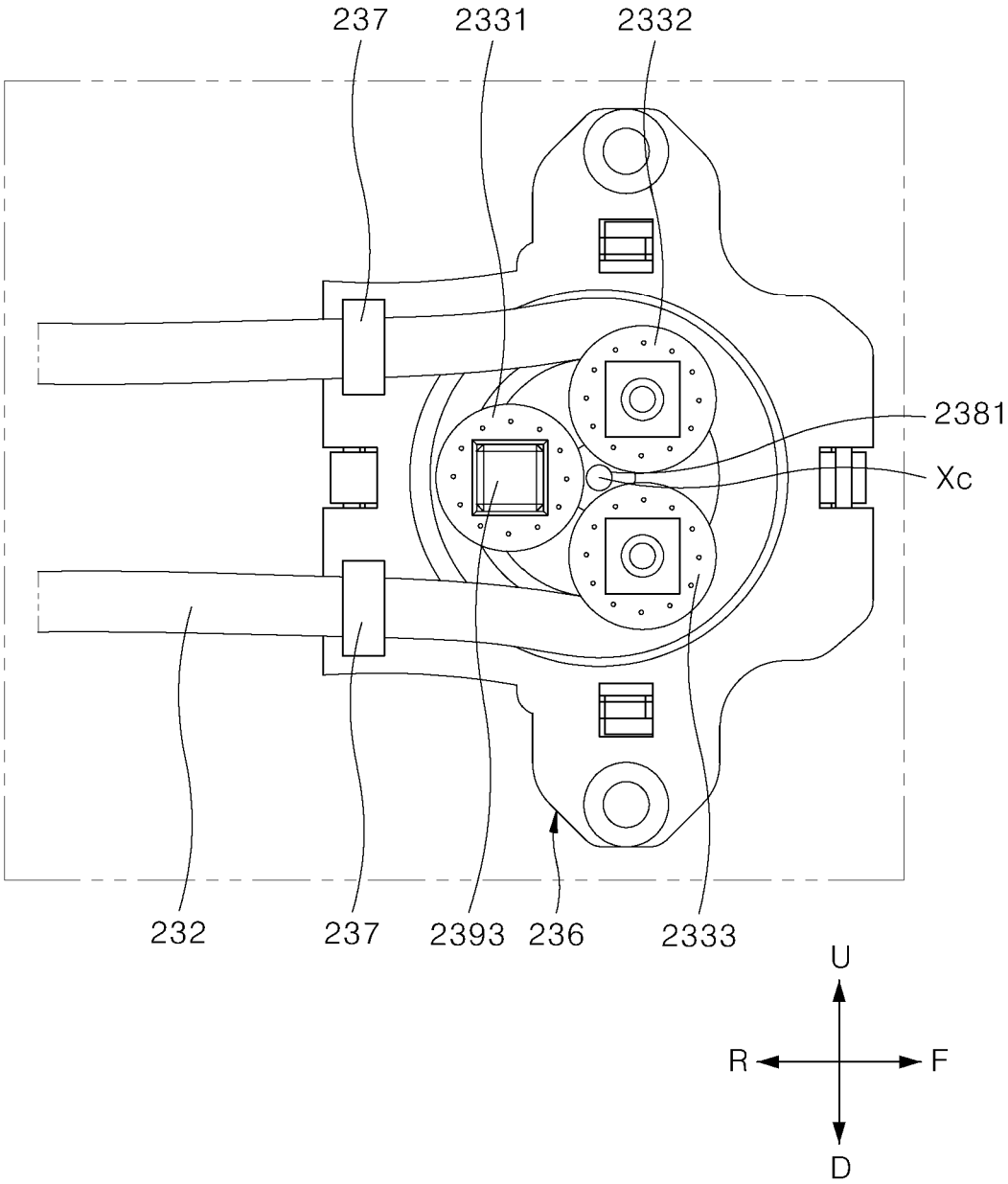
FIG. 14 is a partial enlarged view showing a casing removed from a detergent pump shown in FIG. 8.
Figure 15:
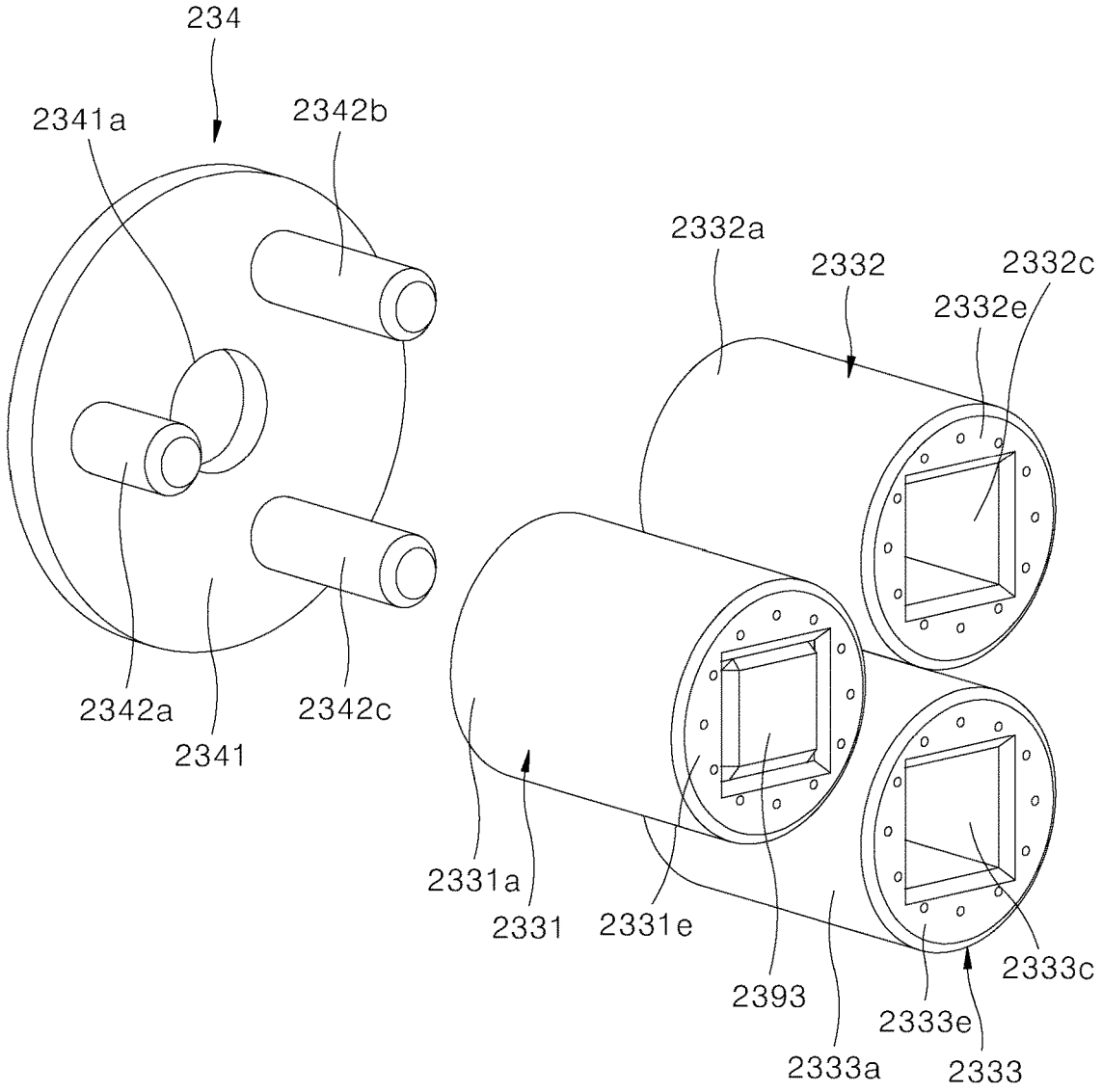
FIG. 15 is an exploded perspective view for illustrating a relationship between a carrier and a plurality of rollers among components shown in FIG. 14.

In this regard, as shown in FIGS. 14 and 15, the first roller 2331, the second roller 2332, and the third roller 2333 may be supported by the carrier 234 in a state of being separated from each other and being able to spin and revolve.

The first shaft 2342*a*, the second shaft 2342*b*, and the third shaft 2342*c* may be disposed in a cylindrical shape on the carrier 234 as means for supporting the first roller 2331, the second roller 2332, and the third roller 2333 so as to be able to spin, respectively.

The first shaft 2342*a*, the second shaft 2342*b*, and the third shaft 2342*c* may be arranged at an equal spacing centered on the through-hole 2341*a* so as to respectively support the first roller 2331, the second roller 2332, and the third roller 2333 in the state of being separated from each other.

First hollows 2331*b*, 2332*b*, and 2333*b* having circular cross-sections into which the first shaft 2342*a*, the second shaft 2342*b*, and the third shaft 2342*c* are respectively inserted may be defined in the first roller 2331, the second roller 2332, and the third roller 2333, respectively.

The first hollows 2331*b*, 2332*b*, and 2333*b* may extend through the first end surfaces 2331*d*, 2332*d*, and 2333*d* of the first roller 2331, the second roller 2332, and the third roller 2333 and extend toward the second end surfaces 2331*e*, 2332*c*, and 2333*e* along the direction of the revolution axis Xc, respectively.

In one example, as described above, the driving force that allows the first roller 2331, the second roller 2332, and the third roller 2333 to spin and revolve is directly transmitted from the output shaft 2381 of the pump motor 238 to the first roller 2331, the second roller 2332, and the third roller 2333 without passing through the carrier 234.

To this end, the first roller 2331, the second roller 2332, and the third roller 2333 may receive the rotational driving force from the output shaft 2381 while simultaneously in contact with the output shaft 2381 of the pump motor 238.

That is, the first roller 2331, the second roller 2332, and the third roller 2333 may be driven by friction between the output shaft 2381 of the pump motor 238 and the outer circumferential surface 2331*a* of the first roller 2331, the outer circumferential surface 2332*a* of the second roller 2332, and the outer circumferential surface 2333*a* of the third roller 2333.

Therefore, means for increasing a coefficient of friction between the output shaft 2381 of the pump motor 238 and the outer circumferential surface 2331*a* of the first roller 2331, the outer circumferential surface 2332*a* of the second roller 2332, and the outer circumferential surface 2333*a* of the third roller 2333 may be disposed on the output shaft 2381. As an example, the means for increasing the coefficient of friction may include a method for roughening a surface of the output shaft 2381 of the pump motor 238, a method for coating the surface of the output shaft 2381 with a predetermined coating material, or a method for covering the surface of the output shaft 2381 using a tube.

However, even though the means for increasing the coefficient of friction is added, there may be a significant deviation between a target detergent supply amount pursued via operating time control or RPM control of the pump motor 238 and an actual supply amount of the detergent pumped and supplied via the first roller 2331, the second roller 2332, and the third roller 2333 such as a case in which a high-viscosity detergent is applied, a case in which hardening and wear of the tube 232 progress over time, and a case in which a slip occurs between the first roller 2331, the second roller 2332, and the third roller 2333 and the output shaft 2381 of the pump motor 238.

Therefore, as mentioned above, in the present disclosure, the number of revolutions of the roller 233, which determines the actual detergent supply amount, may be identified via the number of location changes of the roller 233 to supply the detergent with a minimal deviation from the target detergent supply amount.

To this end, the roller sensor 2391 and the magnetic body 2393 disposed in the roller 233 described above may be disposed as the means for sensing the change in the location of the roller 233.

The magnetic body 2393 may be disposed in all of the first roller 2331, the second roller 2332, and the third roller 2333, but may be disposed in one of the rollers, thereby reducing the manufacturing cost.

Hereinafter, as shown, a description will be mad based on an embodiment in which the magnetic body 2393 is disposed only in the first roller 2331.

Figure 16:
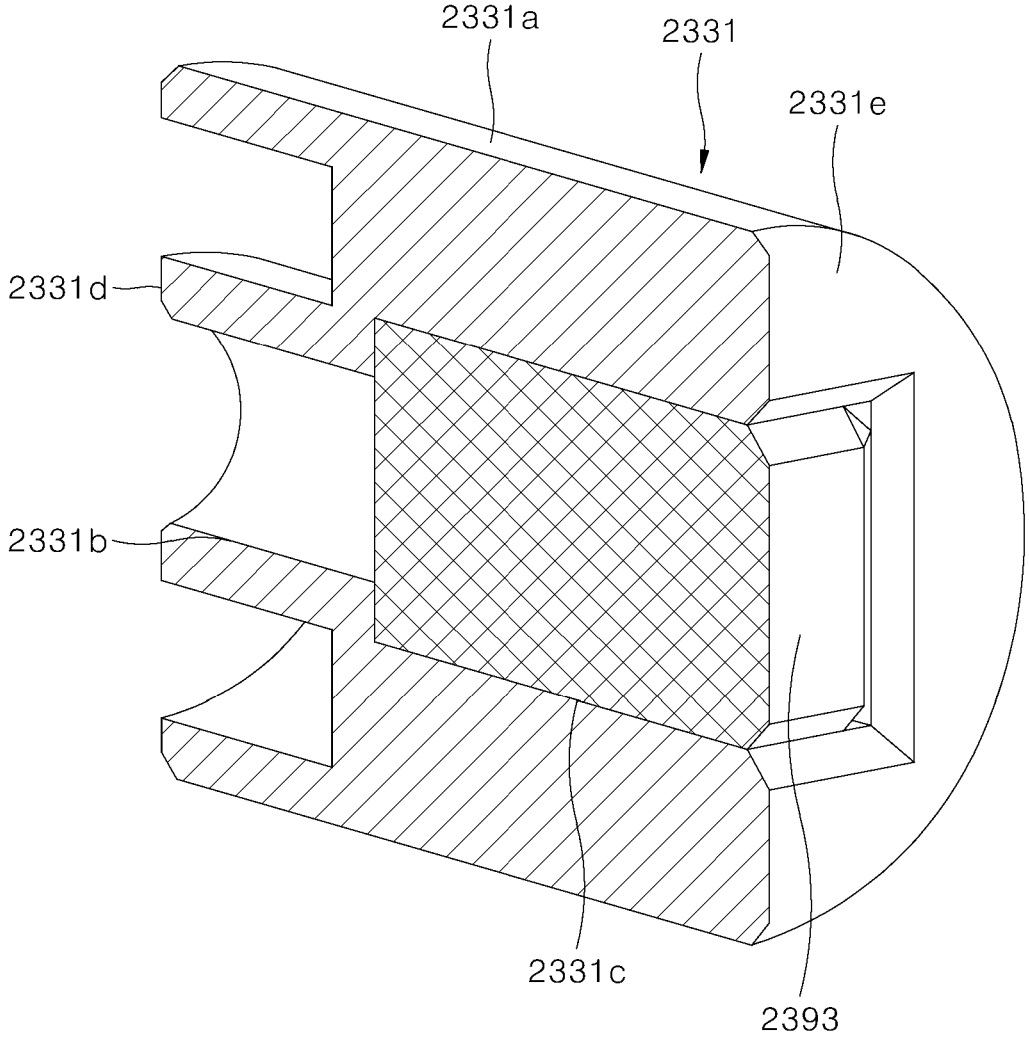
FIG. 16 is a cross-sectional view of a first roller shown in FIG. 15 cut along a longitudinal direction.
Figure 17:
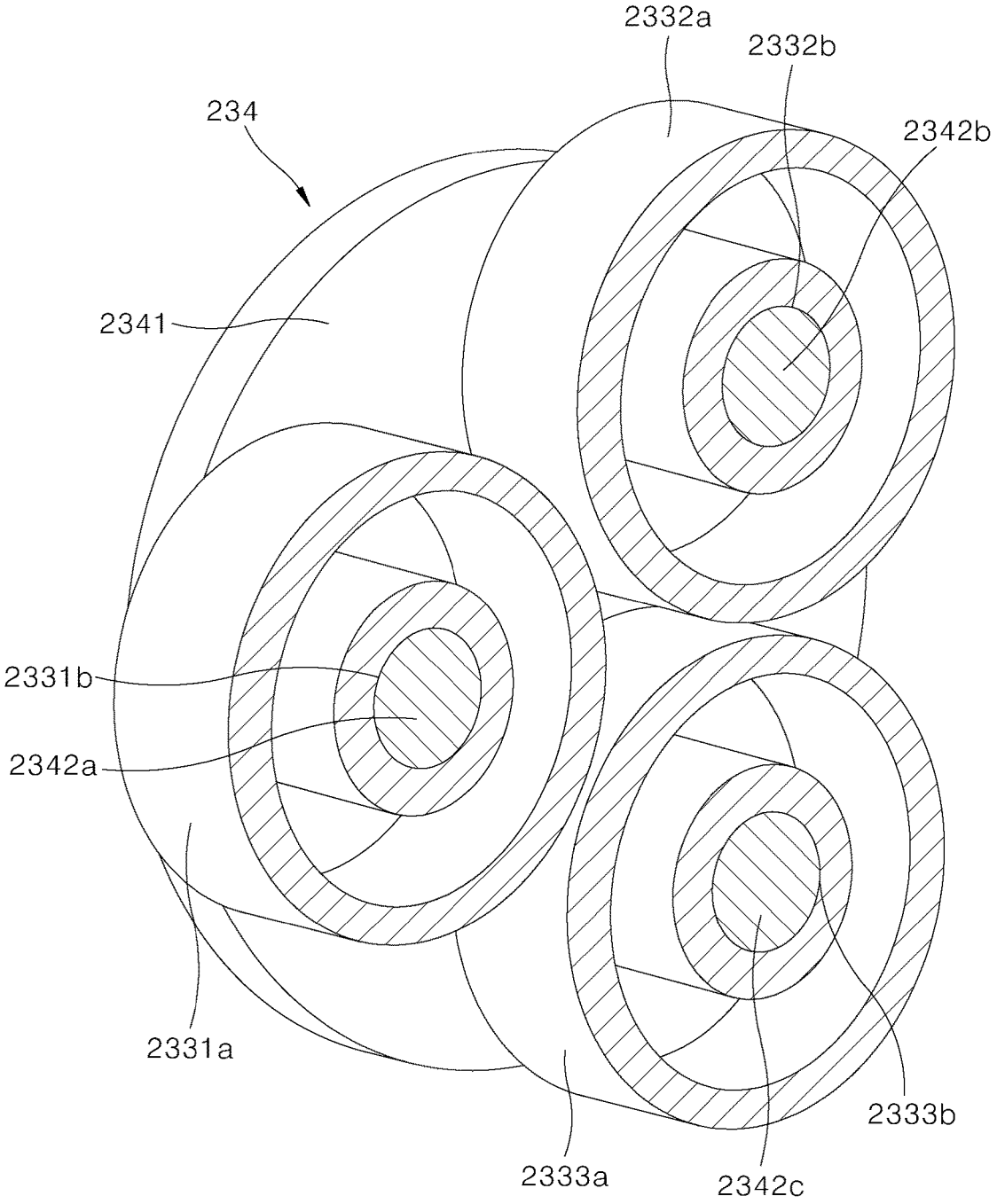
FIGS. 17 and 18 are cross-sectional views cut along a transverse direction of a plurality of rollers in a state in which a carrier shown in FIG. 12 is coupled with the plurality of rollers.
Figure 18:
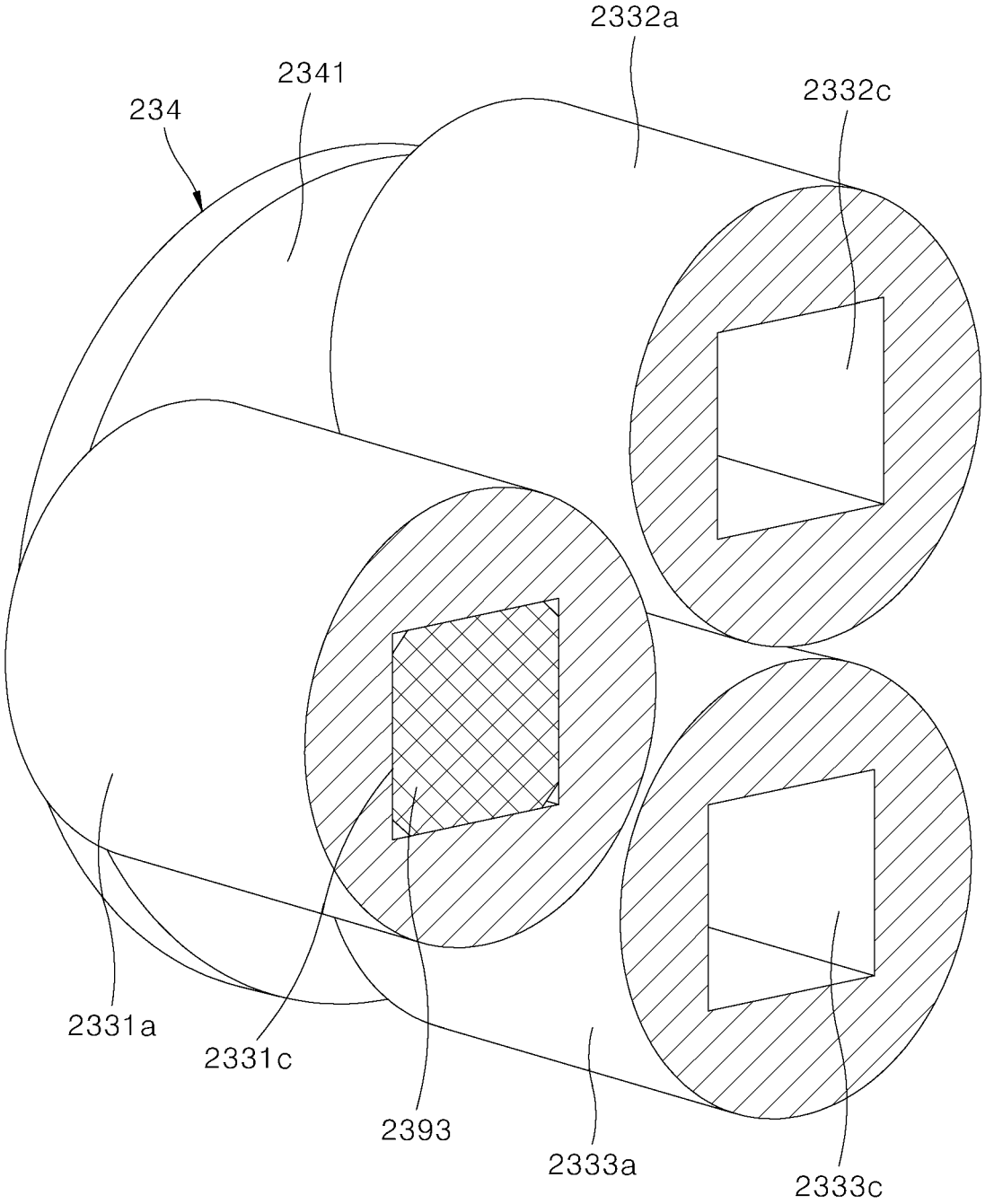

As shown in FIG. 16, the magnetic body 2393 may have an outer appearance of a square pillar shape.

In response to the shape, a second hollow 2331*c* into which the magnetic body may be inserted may be defined inside the first roller 2331.

The second hollow 2331*c* may be defined to have a square cross-sectional shape corresponding to the outer appearance of the magnetic body 2393.

In this regard, the second hollow 2331*c* may extend along the direction of the revolution axis Xc through the second end surface 2331*e* to the first hollow 2331*b*.

Second hollows 2332*c* and 2333*c* having the same shape as the second hollow in the first roller 2331 may be equally defined in the second roller 2332 and the third roller 2333, respectively.

Additionally, the magnetic body 2393 may be disposed in the second hollow 2331*c* so as to be entirely embedded therein. To this end, a length in the direction of the revolution axis Xc of the second hollow 2331*c* may be greater than or equal to a length in the direction of the revolution axis Xc of the magnetic body 2393.

Accordingly, the magnetic body 2393 may not protrude from the second end surface 2331*e* of the first roller 2331, and an increase in a size of the detergent pump 230 resulted from the addition of the magnetic body 2393 may be prevented.

In one example, as shown, the magnetic body 2393 may be disposed closer to the second end surface 2331*e* among the first end surface 2331*d* and the second end surface 2331*e* of the first roller 2331.

As described above, the roller sensor 2391 is disposed on the second end surface 2312 of the pump casing 231 at a location spaced apart from the second end surface 2331*e* along the direction of the revolution axis Xc.

Such location is selected as a location that may minimize the influence of the magnetic force emitted from the pump motor 238.

However, the magnetic body 2393 must be disposed in the first roller 2331 as close as possible to the roller sensor 2391 for the roller sensor 2391 to effectively sense the magnetic body 2393 of the first roller 2331.

To this end, it is preferable that the magnetic body 2393 is disposed to be biased toward the first end surface 2331*d* of the first roller 2331 that is disposed closest to the roller sensor 2391 in the direction of the revolution axis Xc.

[Sensing of Location Change of First Tube Using Roller Sensor]

Hereinafter, referring to FIGS. 19 and 20, an arrangement relationship between the first roller 2331 and the roller sensor 2391 and a sensing structure of the magnetic body 2393 using the roller sensor 2391 will be described.

As described above, the roller sensor 2391 may be disposed as close as possible to the magnetic body 2393 of the first roller 2331 based on the direction of the revolution axis Xc.

Furthermore, the sensing surface 2391*a* of the roller sensor 2391 may be disposed, and the sensing surface 2391*a* of the roller sensor 2391 may be disposed to overlap a revolution area of the magnetic body 2393 in the direction of the revolution axis Xc.

Figure 19:
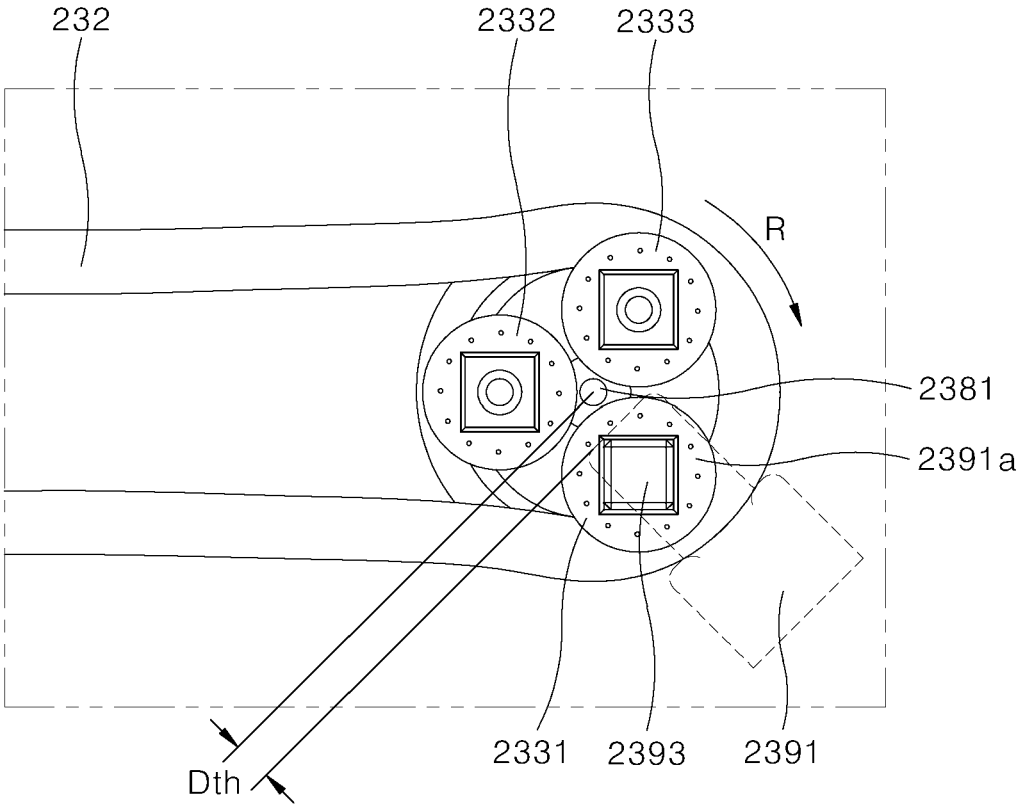
FIG. 19 is a partial enlarged view showing a state in which a first roller is within a sensing range of a roller sensor.

More specifically, as shown in FIG. 19, when the sensing surface 2391*a* is moved in parallel along the direction of the revolution axis Xc toward the magnetic body 2393, the area through which the magnetic body 2393 passes while revolving may overlap the sensing surface 2391*a*.

Accordingly, a straight-line distance between the sensing surface 2391*a* of the roller sensor 2391 and the magnetic body 2393 may be minimized, so that a small magnetic body and a small roller sensor 2391 may be applied. Therefore, the detergent pump 230 may be miniaturized and the manufacturing cost of the detergent pump 230 may be reduced.

Hereinafter, a method for sensing the change in the location of the first roller 2331 using the roller sensor 2391 will be described.

The roller sensor 2391 may be constructed to have a predetermined sensing area.

For example, as shown in FIG. 19, an area in which a distance D from the sensing surface 2391*a* to the magnetic body 2393 of the first roller 2331 based on the revolution axis Xc is smaller than a distance, which is a reference distance range Dth, from the revolution axis Xc to the sensing surface may be the sensing area of the roller sensor 2391, and the distance D from the sensing surface 2391*a* to the magnetic body 2393 of the first roller 2331 is greater than the reference distance range may be a non-sensing area.

As shown in FIG. 19, when the magnetic body 2393 of the first roller 2331 exists within the sensing area, the roller sensor 2391 may sense the existence and generate a first output signal containing information indicating that the first roller 2331 is within the sensing area.

Figure 20:
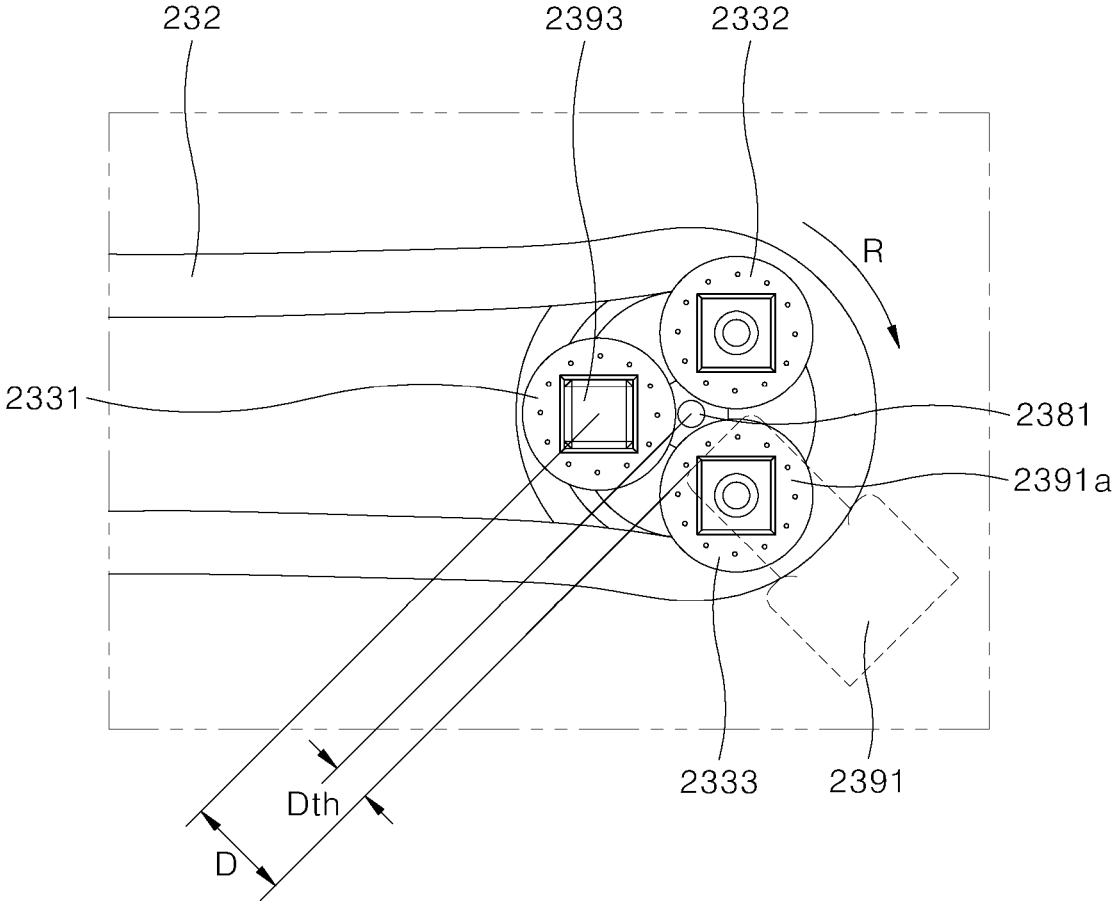
FIG. 20 is a partially enlarged view showing a state in which a first roller revolves and is out of a sensing range of a roller sensor from a state in FIG. 19.

In one example, as shown in FIG. 20, when the first roller 2331 revolves along a revolution direction R and is out of the sensing area and exists in the non-sensing area, the roller sensor 2391 may sense the same and generate a second output signal containing information indicating that the first roller 2331 is out of the sensing range of the roller sensor 2391 and exists in the non-detection area.

Such first output signal and second output signal may be transmitted as electrical signals to the controller 100, which will be described later, and the controller 100 may easily identify that the first roller 2331 has revolved and the location of the first roller 2331 has changed when the signal received from the roller sensor 2391 changes from the first output signal to the second output signal or from the second output signal to the first output signal.

[Configuration of Controller and Method for Controlling Dish Washer]

Hereinafter, referring to FIG. 21, a configuration of the controller 100 of the dish washer 1 according to one embodiment of the present disclosure will be described.

Figure 21:
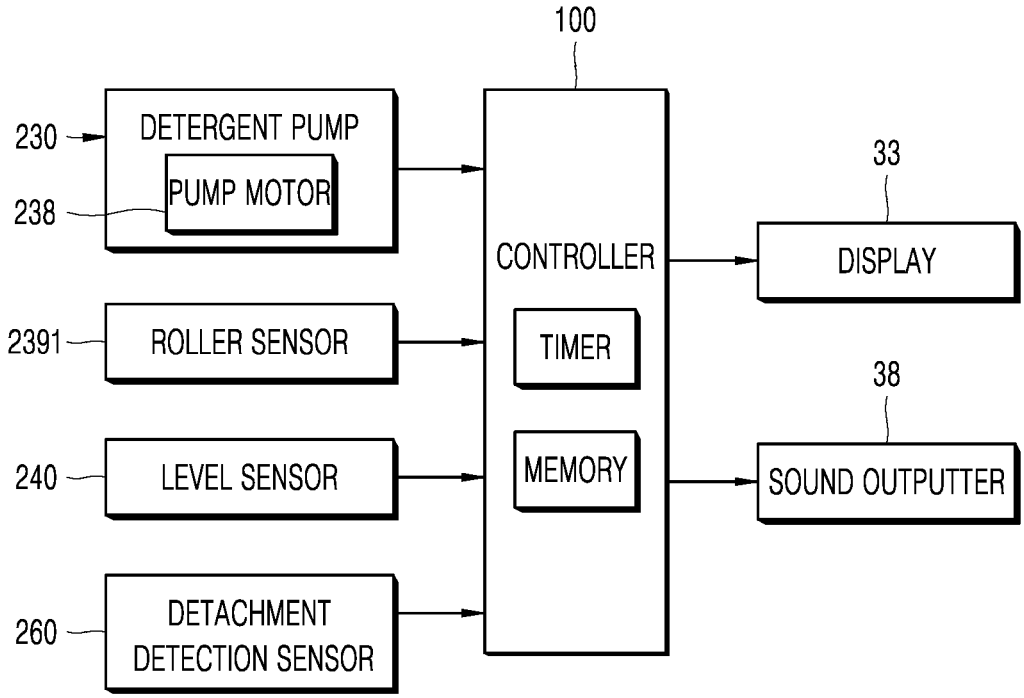
FIG. 21 is a functional block diagram for illustrating a configuration of a controller of a dish washer according to an embodiment of the present disclosure.

As shown in FIG. 21, the dish washer 1 according to one embodiment of the present disclosure may include the controller 100 for controlling each functional component.

The controller 100 may be of various forms such as a microcontroller, a microcomputer, or a microprocessor, as known in the art.

First, the controller 100 may be electrically connected to the pump motor 238 of the detergent pump 230. After the washing process is initiated, the controller 100 may perform control such that the power is supplied to the pump motor 238 to operate the detergent pump 230 and the detergent is supplied to the tub 20.

Additionally, the controller 100 may be electrically connected to the roller sensor 2391 for sensing the change in the location of the first roller 2331 in real time during the washing process.

As described above, when the magnetic body 2393 of the first roller 2331 exists within the sensing area, the roller sensor 2391 may generate the first output signal and transmit the first output signal to the controller 100, and when the magnetic body 2393 of the first roller 2331 is out of the sensing area and exists in the non-sensing area, the roller sensor 2391 may generate the second output signal and transmit the second output signal to the controller 100.

The first output signal may contain the information indicating that the first roller 2331 is within the sensing area of the roller sensor 2391, and the second output signal may contain the information indicating that the first roller 2331 is out of the sensing area of the roller sensor 2391 and exists in the non-sensing area.

The controller 100 may identify that the first roller 2331 has revolved and the location of the first roller 2331 has changed when the signal received from the roller sensor 2391 changes from the first output signal to the second output signal or from the second output signal to the first output signal.

In one example, the controller 100 may be electrically connected to the level sensor 240 for sensing the remaining amount of detergent stored in the detergent container 280.

The output signal of the level sensor 240 may be transmitted to the controller 100, and the controller 100 may easily identify the remaining amount of detergent stored inside the container body 281 via the received output signal of the level sensor 240. In this regard, when the remaining amount of detergent sensed via the level sensor 240 is equal to or smaller than a predetermined amount, the controller 100 may control a visual alarm or an acoustic alarm containing information indicating that the remaining amount of detergent is insufficient to be generated via the display or a sound outputter 38.

In one example, the controller 100 may be electrically connected to the detachment detection sensor 260 for sensing the detachment of the detergent container 280.

The output signal of the detachment detection sensor 260 may be transmitted to the controller 100, and the controller 100 may easily identify whether the detergent container 280 is mounted in the housing 210 or is removed from the housing 210 via the received output signal of the detachment detection sensor 260.

When determining that the detergent container 280 is removed, the controller 100 may control a visual alarm or an acoustic alarm containing information indicating that the detergent container 280 is not mounted to be generated via the display or the sound outputter 38.

In one example, the controller 100 is electrically connected to a memory and a timer. The controller 100 calls operation conditions, time conditions, and the like for each process pre-stored in the memory and uses the called conditions to generate a control signal for controlling progress and termination of the process. Furthermore, information regarding the supply amount (a preset amount) of the detergent to be supplied during the washing process may be further stored in the memory.

Furthermore, set time information for determining the viscosity of the detergent stored in the detergent container 280 or whether an error has occurred in the detergent pump may be further stored in the memory. The set time may include a first set time t1, a second set time t2 that is longer than the first set time t1, and a third set time t3 that is longer than the second set time t2.

As an example, the first set time t1 may be 50 seconds, the second set time t2 may be 60 seconds, and the third set time t3 may be 2 minutes.

Additionally, information regarding a washing process mode suitable for each state of the detergent stored in the detergent container 280, that is, each viscosity of the detergent, may be stored in the memory.

The washing process mode may include a first mode and a second mode, the first mode may be a normal mode, and the second mode may be a soft mode.

The soft mode may be a mode in which conditions of the washing process are partially changed to be suitable for the medium-viscosity detergent, compared to the normal mode. The partial change may include the adjustment of the washing process time or the adjustment of the pressure of the washing water sprayed via the spray arm.

In addition, the controller 100 may use the timer to calculate an elapsed time or the like for each process, compare the elapsed time with the pre-stored time conditions for each process, and determine whether to complete each process. In this regard, each process may include a preliminary washing process, a washing process, a rinsing process, a heated rinsing process, and a drying process.

In particular, as will be described later, an elapsed time tm after the operation of the pump motor 238 is initiated by the controller 100 may be calculated via the timer. The elapsed operating time tm of the pump motor 238 calculated via the timer may be compared with the set time stored in advance in the memory, and the viscosity of the detergent stored in the detergent container 280 may be determined based on the comparison result.

Additionally, the controller 100 is electrically connected to the display and the sound outputter.

The controller 100 may control information regarding the operating state, an operating time, whether the process is complete, and the like of the dish washer 1 to be visually displayed via the display, and control an alarm regarding the operating state of the dish washer 1 or the completion of the process to be output as a voice or a sound via the above-described sound outputter such as a buzzer or a speaker.

In addition, as will be described later, when it is determined that the viscosity of the detergent stored in the detergent container 280 is high, the controller 100 may control the display or the sound outputter such that a visual alarm containing information for inducing replacement of the detergent stored in the detergent container 280 with the low-viscosity detergent is output via the display or a voice/sound alarm is output via the sound outputter.

In addition, as will be described later, when it is determined that the error has occurred in the detergent pump 230, the controller 100 may control the display or the sound outputter such that a visual alarm containing information indicating that the error or a failure has occurred in the detergent pump 230 is output via the display or a voice/sound alarm is output via the sound outputter.

Additionally, the controller 100 may be electrically connected to a wireless communication unit. The controller 100 may be directly connected to a terminal of the user via the wireless communication unit or may be indirectly connected to the terminal via a repeater or the like. There is no limit to an applicable communication method, but for example, the wireless communication unit may be formed as a Wi-Fi module.

The controller 100 may receive a control signal for the operation of the dish washer 1 via the wireless communication unit, or transmit information regarding the operation of the dish washer 1, information regarding a progress state of the process, information indicating that the error has occurred in the detergent pump 230 as will be described later, and information indicating that the washing process needs to be stopped to the terminal of the user.

Hereinafter, referring to FIGS. 22 to 26, a method (S10) for controlling the dish washer 1 according to the present disclosure will be described.

As described above, the dish washer 1 according to the present disclosure is to receive the output signal from the roller sensor 2391 during the washing process, and effectively identify whether the error has occurred in the detergent pump 230 or the viscosity of the detergent stored in the detergent container 280 based on the number of revolutions of the first roller 2331 and the elapsed operating time tm of the pump motor 238 that are calculated from a change in the received output signal.

Figure 22:
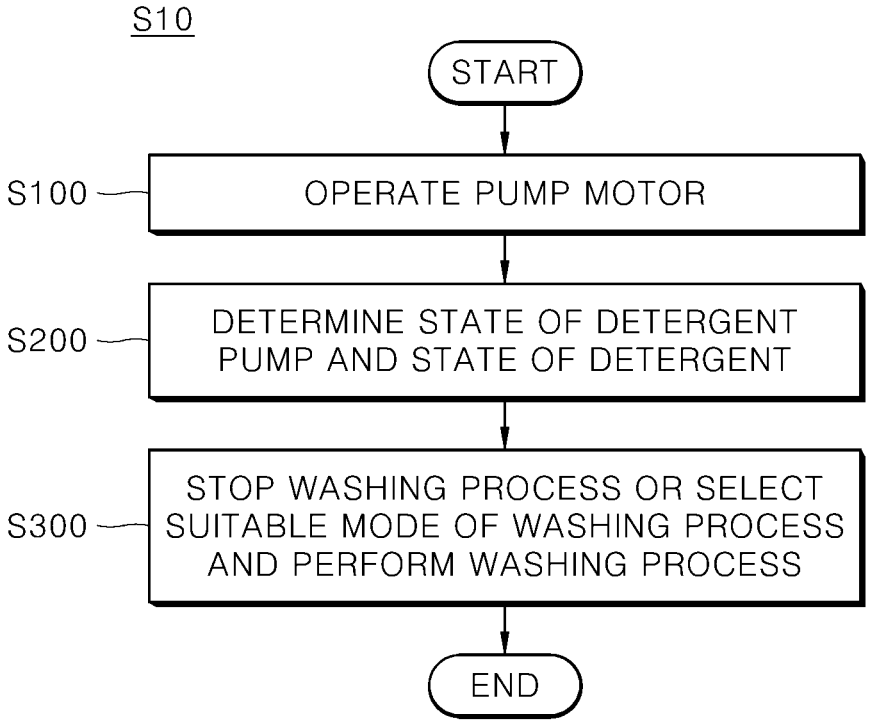
FIGS. 22 to 26 are flowcharts for illustrating control steps performed by a controller shown in FIG. 21.

FIG. 22 shows a process in which the supply of the detergent is initiated via the detergent supply 200 during initiation and progress of the washing process of the dish washer 1, the state of the detergent pump 230 or the state of the detergent, that is, the viscosity of the detergent, stored in the detergent container 280 is determined based on the output signal received from the roller sensor 2391, and the washing process is stopped or a mode of a washing process suitable for the state of the detergent is selected and the washing process is performed depending on the selected mode of the washing process based on the determined state of the detergent pump 230 or the determined state of the detergent.

Referring to FIG. 22, the controller 100 may operate the pump motor 238 by supplying the power to the pump motor 238 to initiate the supply of the detergent (S100).

After the operation of the pump motor 238 is initiated, the controller 100 may measure the elapsed time tm after the operation of the pump motor 238 is initiated using the timer, calculate the number of revolutions of the first roller 2331, and determine whether the error has occurred in the detergent pump 230 or determine the viscosity of the detergent stored in the detergent container 280 based on the measured elapsed time tm and the calculated number of revolutions (S200).

Next, based on the results of S200 above, the controller 100 may stop the washing process or select the washing process mode suitable for the viscosity of the detergent stored in the detergent container 280 (S300).

FIGS. 23 to 26 show detailed steps of S200 and S300.

Figure 23:
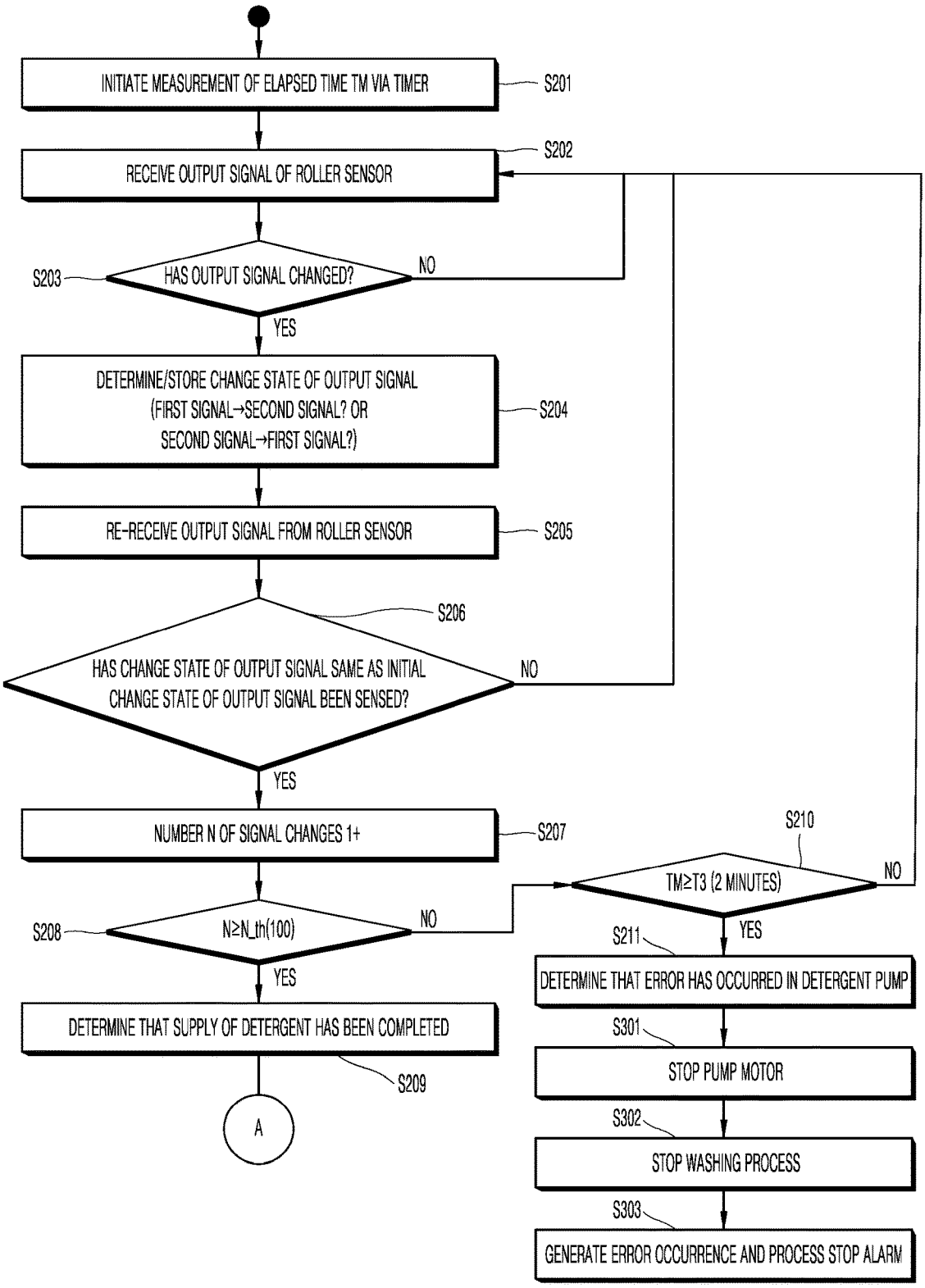

Referring to FIG. 23, first, the controller 100 initiates the measurement of the elapsed time tm after the operation of the pump motor 238 is initiated using the timer (S201).

Next, the controller 100 receives the output signal including one of the first output signal and the second output signal from the roller sensor 2391 (S202).

As described above, the first output signal may be a signal containing the information indicating that the first roller 2331 is within the sensing range of the roller sensor 2391, and the second output signal may be a signal containing the information indicating that the first roller 2331 is located at the location out of the sensing range of the roller sensor 2391.

Next, when the output signal is received from the roller sensor 2391, the controller 100 determines whether the change of the received output signal from the first output signal to the second output signal or from the second output signal to the first output signal has initially occurred (S203).

Next, when it is determined in S203 that the change of the output signal has initially occurred, the controller 100 determines an initial change state of the output signal (S204).

In this regard, the initial change state may be one of the first change state in which the output signal of the roller sensor 2391 changes from the first output signal to the second output signal and the second change state in which the output signal of the roller sensor 2391 changes from the second output signal to the first change state.

Next, when the initial change state of the output signal is determined in S204, the controller 100 re-receives the output signal from the roller sensor 2391 (S205).

Next, the controller 100 determines whether a change of the output signal the same as the initial change state has occurred from the output signal re-received in S205 (S206).

That is, when it is determined in S204 that the initial change state is the first change state, the controller 100 determines whether the first change state the same as the initial change state has occurred, and when it is determined in S204 that the initial change state is the second change state, the controller 100 determines whether the second change state the same as the initial change state has occurred.

Next, when it is determined in S206 that the change of the output signal the same as the initial change state has occurred from the output signal re-received, the controller 100 increases the number N of signal changes by one and stores the updated number N of signal changes in the memory (S207).

In this regard, the number N of signal changes updated and stored may be the number of revolutions of the first roller 2331 calculated after the initiation of the operation of the pump motor 238.

Next, the controller 100 compares the number N of signal changes updated in S207 with the preset number N_th (S208).

In this regard, the preset number N_th may be 100 as an example.

In one example, when it is determined as a result of the comparison in S208 that the updated number N of signal changes has reached the preset number N_th, the controller 100 may determine that the supply amount of detergent that is supplied after the operation of the pump motor 238 is initiated has reached the preset detergent supply amount, and determine that the supply of the detergent has been completed.

In other words, the controller 100 calculates the number of revolutions of the first roller 2331 based on the number of location changes of the first roller 2331, and determines that the preset detergent supply amount has been reached when the calculated number of revolutions of the first roller 2331 reaches the preset number N_th.

When it is determined that the supply of the detergent has been completed, the controller 100 cuts off the power supply to the pump motor 238 and stops the pump motor 238 (S209).

Figure 24:
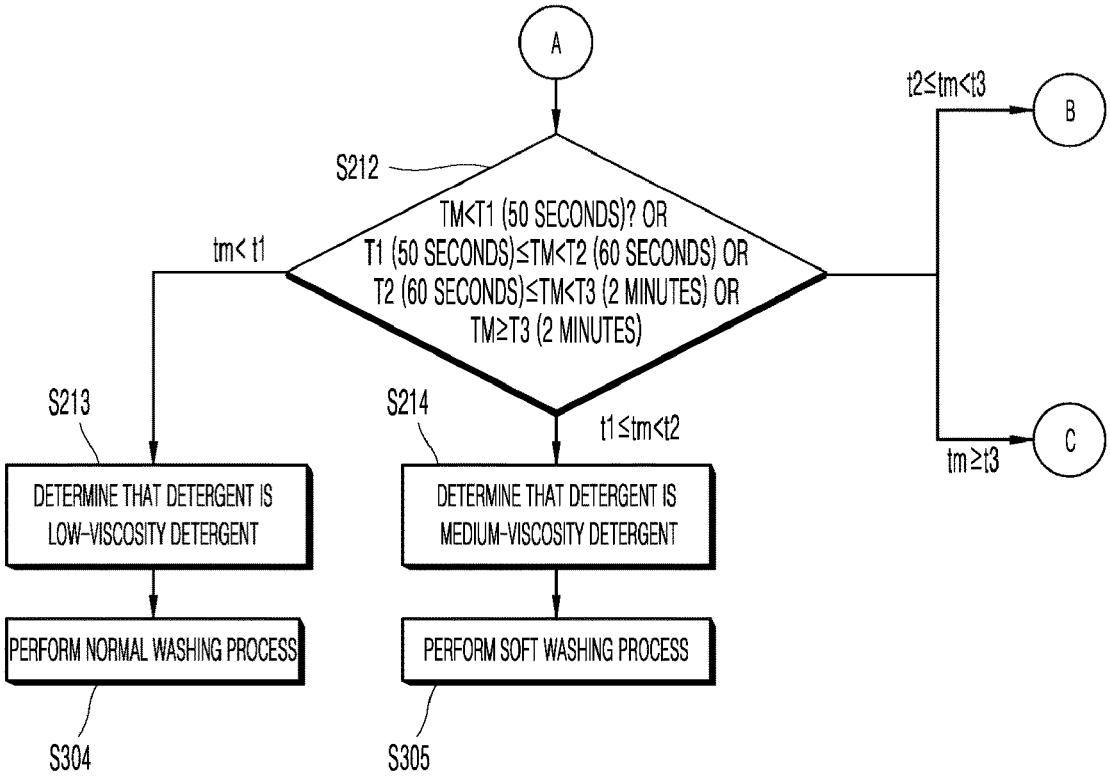

When the pump motor 238 is stopped in S209 as such, as shown in FIG. 24, the controller 100 calls the predetermined set time from the memory and compares the set time with the elapsed time from the initiation of the operation of the pump motor to the stopping of the operation of the pump motor (S212).

In this regard, the predetermined set time may include the first set time t1, the second set time t2 that is longer than the first set time t1, and the third set time t3 that is longer than the second set time t2.

As an example, the first set time t1 may be 50 seconds, the second set time t2 may be 60 seconds, and the third set time t3 may be 2 minutes.

When it is determined as a result of the comparison in S212 that the elapsed time tm is shorter than the first set time t1, the controller 100 determines that the detergent stored in the detergent container 280 is the low-viscosity detergent (S213).

In other words, the controller 100 may determine that the supply of the preset amount of detergent via the detergent pump 230 has been completed within the first set time t1, which is a relatively short period of time, and accordingly, determine that the viscosity of the detergent stored in the detergent container 280 is low.

When it is determined in S213 that the viscosity of the detergent is low, the controller 100 determines the mode of the washing process to be the normal mode (S304).

Accordingly, the controller 100 may call washing process conditions corresponding to the normal mode from the memory, and control a remaining washing process to proceed based on the called washing process conditions.

In one example, when it is determined as the result of the comparison in S212 that the elapsed time tm is equal to or longer than the first set time t1 and shorter than the second set time t2, the controller 100 determines that the detergent stored in the detergent container 280 is the medium-viscosity detergent (S214).

In other words, the controller 100 may determine that the supply of the preset amount of detergent via the detergent pump 230 has been completed within a time period, which is an intermediate time band, between the first set time t1 and the second set time t2, and accordingly, may determine that the viscosity of the detergent stored in the detergent container 280 is medium.

When it is determined in S214 that the viscosity of the detergent is medium, the controller 100 determines the mode of the washing process to be the soft mode (S305).

Accordingly, the controller 100 may call washing process conditions corresponding to the soft mode from the memory, and control a remaining washing process to be performed based on the called washing process conditions.

As mentioned above, the soft mode may be the mode in which the conditions of the washing process are partially changed to be suitable for the medium-viscosity detergent, compared to the normal mode. The partial change may include the adjustment of the washing process time, the adjustment of the pressure of the washing water sprayed via the spray arm, or the adjustment of the temperature of the washing water.

Figure 25:
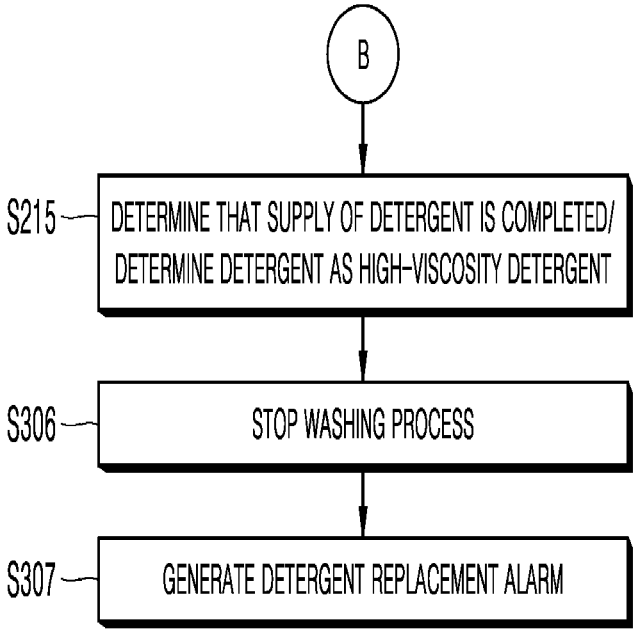

In one example, when it is determined as the result of the comparison in S212 that the elapsed time tm is equal to or longer than the second set time t2 and shorter than the third set time t3, as shown in FIG. 25, the controller 100 determines that the detergent stored in the detergent container 280 is the high-viscosity detergent (S215).

In other words, the controller 100 may determine that the supply of the preset amount of detergent via the detergent pump 230 has been completed within a time period, which is a relatively long time band, between the second set time t2 and the third set time t3, and accordingly, may determine that the viscosity of the detergent stored in the detergent container 280 is high.

When it is determined in S215 that the viscosity of the detergent is high, the controller 100 determines to stop the washing process (S306).

In other words, when the viscosity of the detergent currently stored in the detergent container 280 is high, such high-viscosity detergent may be unsuitable for the supply of the detergent via the detergent pump 230. Therefore, when it is determined that the detergent stored in the detergent container 280 is the unsuitable high-viscosity detergent, the controller 100 stops the remaining washing process to prevent damage to the detergent pump 230.

Next, when it is determined in S306 to stop the washing process, the controller 100 may control the display or the sound outputter such that a visual alarm containing information for inducing replacement of the detergent stored in the detergent container 280 with the low-viscosity detergent is output via the display or a voice/sound alarm is output via the sound outputter (S307).

Via such detergent replacement alarm, the replacement of the detergent by the user may be effectively induced.

Figure 26:
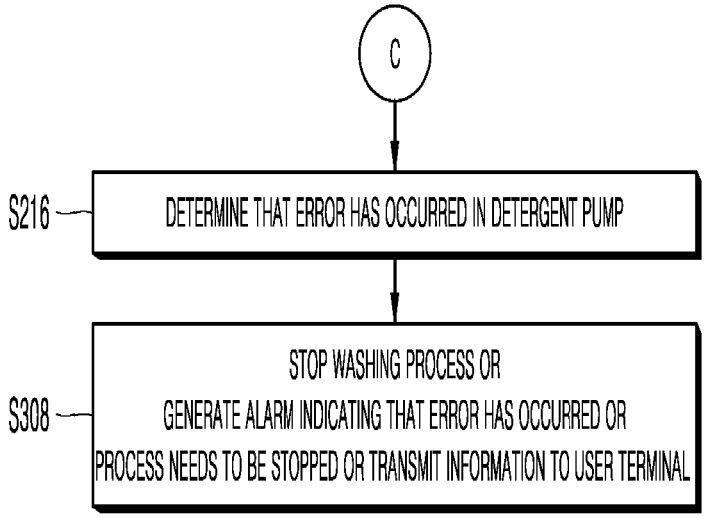

In one example, when it is determined as the result of the comparison in S212 that the elapsed time tm is equal to or longer than the third set time t3, as shown in FIG. 26, the controller 100 determines that the error has occurred in the detergent pump 230 (S216).

In other words, when it is determined that the supply of the detergent has been completed after the third set time t3, which is the longest among the set times, elapses, the controller 100 may determine that the failure or breakdown has occurred in the detergent pump 230 itself.

Factors that cause the failure in the detergent pump 230 may include various mechanical factors such as blockage of the tube 232, blockage of the container valve 282, and the failure of the pump motor 238.

When it is determined that the error has occurred in the detergent pump 230 as such, the controller 100 may determine to stop the remaining washing process, may control the display or the sound outputter such that the visual alarm containing the information indicating that the error or the failure has occurred in the detergent pump 230 or the information indicating that the washing process needs to be stopped is output via the display or the voice/audio alarm is output via the sound outputter, or may transmit the information indicating that the error or the failure has occurred in the detergent pump 230 or the information indicating that the washing process needs to be stopped to the terminal of the user via the wireless communication unit (S308).

The stopping of the washing process may be induced or user actions such as repairing or replacing the detergent supply 200 may be effectively induced via such an error occurrence alarm.

In one example, when it is determined as the result of the comparison in S208 that the updated number N of signal changes has not reached the preset number N_th, as shown in FIG. 23, the controller 100 compares the elapsed time tm from the initiation of the operation of the pump motor 238 to the present with the third set time described above (S210).

When it is determined in S210 that the elapsed time is equal to or longer than the third set time, it is determined that the error has occurred in the detergent pump 230 (S211).

In other words, when it is determined that the supply of the detergent has not been completed by a time point at which the third set time t3, which is the longest among the set times, has passed, the controller 100 may determine that the failure or the breakdown has occurred in the detergent pump 230 itself.

As mentioned above, the factors that cause the failure in the detergent pump 230 may include the various mechanical factors such as the blockage of the tube 232, the blockage of the container valve 282, and the failure of the pump motor 238.

When it is determined that the error has occurred in the detergent pump 230, the pump motor 238 is stopped to stop the supply of the detergent to prevent further failure of the detergent supply 200 (S301).

When the pump motor 238 is stopped in S301, the controller 100 may determine to stop the remaining washing process, and control the display or the sound outputter such that the visual alarm containing the information indicating that the error or the failure has occurred in the detergent pump 230 is output via the display or the voice/sound alarm is output via the sound outputter (S302 and 303).

As such, the detergent supply 200 of the dish washer 1 according to the present disclosure may be controlled to calculate the number of revolutions of the first roller 2331 and determine the viscosity of the detergent stored in the detergent container 280 based on the calculated number of revolutions of the first roller 2331 and the operating time of the pump motor 238. Accordingly, as described above, the separate electrode sensor for sensing the viscosity of the detergent may be eliminated, which may simplify the structure, improve the space utilization, and reduce the manufacturing cost.

As described above, the present disclosure has been described with reference to illustrative drawings, but the present disclosure is not limited by the embodiments disclosed herein and the drawings, and it is obvious that various modifications may be made by those skilled in the art within the scope of the technical idea of the present disclosure. In addition, although effects of a component of the present disclosure were not explicitly described when describing the embodiment of the present disclosure above, it is natural that the predictable effects of the corresponding component should also be recognized.

What is claimed is:

1. A dish washer comprising:

a tub that defines a washing space therein;

a detergent supply comprising (i) a container configured to store detergent to be provided to the washing space and (ii) a detergent pump configured to supply the detergent in the container to the washing space; and a controller configured to control the detergent pump during a washing process, wherein the detergent pump comprises:

a tube configured to guide the detergent discharged from the container to the washing space, a roller configured to pressurize the tube, the roller being configured to revolve about a revolution axis to thereby cause the detergent inside the tube to flow, a pump motor configured to generate a driving force to move the roller, and a roller sensor configured to sense a location of the roller and to generate an output signal corresponding to the location of the roller, and wherein the controller is configured to:

determine a state of the detergent pump or a state of the detergent based on the output signal received from the roller sensor, and based on the state of the detergent pump or the state of the detergent, (i) stop the washing process or (ii) select a mode of the washing process corresponding to the state of the detergent and perform the selected mode of the washing process.

2. The dish washer of claim 1, wherein the controller is configured to determine the state of the detergent pump or the state of the detergent by:

initiating an operation of the pump motor and starting to measure an elapsed time since the operation of the pump motor is initiated; and determining whether a preset amount of detergent has been supplied to the tub based on the output signal that is received from the roller sensor after starting to measure the elapsed time.

3. The dish washer of claim 2, wherein the controller is configured to determine whether the preset amount of detergent has been supplied to the tub by:

receiving a first output signal and a second output signal from the roller sensor;

determining whether (i) a first change from the first output signal to the second output signal or (ii) a second change from the second output signal to the first output signal has occurred;

determining that an initial change state of the output signal has occurred based on a determination that the first change or the second change has occurred;

determining whether a change of the output signal corresponds to the initial change state;

increasing a number of signal changes, and storing an updated number of signal changes based on a determination that the change of the output signal corresponds to the initial change state; and comparing the updated number of signal changes to a preset number.

4. The dish washer of claim 3, wherein the roller sensor is configured to:

generate the first output signal based on the roller being located within a sensing range of the roller sensor; and generate the second output signal based on the roller being located out of the sensing range of the roller sensor, and wherein the initial change state is one of (i) a first change state of the output signal changing from the first output signal to the second output signal or (ii) a second change state of the output signal changing from the second output signal to the first output signal.

5. The dish washer of claim 3, wherein the controller is configured to further receive the output signal from the roller sensor after determining the initial change state of the output signal.

6. The dish washer of claim 3, wherein the controller is further configured to determine that the preset amount of detergent has been supplied to the tub based on a determination that the updated number of signal changes has reached the preset number.

7. The dish washer of claim 3, wherein the controller is configured to determine a number of revolutions of the roller based on the number of signal changes.

8. The dish washer of claim 1, wherein the controller is configured to determine the state of the detergent pump or the state of the detergent by:

determining that a preset amount of detergent has been supplied to the tub;

stopping an operation of the pump motor based on the output signal that is received from the roller sensor after starting the operation of the pump motor;

determining an elapsed time from an initiation instant of starting the operation of the pump motor to a stop instant of stopping the operation of the pump motor;

comparing the elapsed time to a predetermined set time; and based on a result of comparing the elapsed time to the predetermined set time, determining (i) that an error has occurred in the detergent pump or (ii) the mode of the washing process.

9. The dish washer of claim 8, wherein the controller is configured to:

determine the mode of the washing process to be a first mode based on a determination that the elapsed time is less than a first set time;

determine the mode of the washing process to be a second mode based on a determination that the elapsed time is greater than or equal to the first set time and less than a second set time; and determine to stop the washing process based on a determination that the elapsed time is greater than or equal to the second set time and less than a third set time.

10. The dish washer of claim 8, wherein the controller is configured to:

determine that the error has occurred in the detergent pump based on a determination that the elapsed time is greater than or equal to a set time; and based on a determination that the error has occurred in the detergent pump, determine to stop the washing process, and (i) generate a visual alarm or an auditory alarm including predetermined information via a display or a sound outputter, or (ii) transmit a signal including the predetermined information to a terminal of a user, and wherein the predetermined information comprises information indicating that the error has occurred in the detergent pump or information indicating that the washing process is in a stop condition.

11. A method for controlling a dish washer, the dish washer including a tub that defines a washing space therein, a detergent supply that includes (i) a container configured to store detergent to be provided to the washing space and (ii) a detergent pump configured to supply the detergent in the container to the washing space, and a controller configured to control the detergent pump during a washing process, wherein the detergent pump includes a tube configured to guide the detergent discharged from the container to the washing space, a roller configured to pressurize the tube, the roller being configured to revolve about a revolution axis to thereby cause the detergent inside the tube to flow, a pump motor configured to generate a driving force to move the roller, and a roller sensor configured to sense a location of the roller and to generate an output signal corresponding to the location of the roller, the method comprising:

determining a state of the detergent pump or a state of the detergent based on the output signal received from the roller sensor; and based on the state of the detergent pump or the state of the detergent, (i) stopping the washing process or (ii) selecting a mode of the washing process corresponding to the state of the detergent and performing the selected mode of the washing process.

12. The method of claim 11, wherein determining the state of the detergent pump or the state of the detergent comprises:

initiating an operation of the pump motor and starting to measure an elapsed time since the operation of the pump motor is initiated; and determining whether a preset amount of detergent has been supplied to the washing space based on the output signal that is received from the roller sensor after starting to measure the elapsed time.

13. The method of claim 12, wherein determining whether the preset amount of detergent has been supplied to the washing space comprises:

receiving a first output signal and a second output signal from the roller sensor;

determining whether (i) a first change from the first output signal to the second output signal or (ii) a second change from the second output signal to the first output signal has occurred;

determining that an initial change state of the output signal has occurred based on a determination that the first change or the second change has occurred;

determining whether a change of the output signal corresponds to the initial change state;

increasing a number of signal changes, and storing an updated number of signal changes based on a determination that the change of the output signal corresponds to the initial change state; and comparing the updated number of signal changes to a preset number.

14. The method of claim 13, wherein the first output signal includes information indicating that the roller is located within a sensing range of the roller sensor, wherein the second output signal includes information indicating that the roller is located out of the sensing range of the roller sensor, and wherein the initial change state is one of (i) a first change state of the output signal changing from the first output signal to the second output signal or (ii) a second change state of the output signal changing from the second output signal to the first output signal.

15. The method of claim 13, further comprising:

receiving the output signal from the roller sensor after determining the initial change state of the output signal.

16. The method of claim 13, further comprising:

determining that the preset amount of detergent has been supplied to the washing space based on a determination that the updated number of signal changes has reached the preset number.

17. The method of claim 13, further comprising:

determining a number of revolutions of the roller based on the number of signal changes.

18. The method of claim 11, wherein determining the state of the detergent pump or the state of the detergent comprises:

determining that a preset amount of detergent has been supplied to the tub;

stopping an operation of the pump motor based on the output signal that is received from the roller sensor after starting the operation of the pump motor;

determining an elapsed time from an initiation instant of starting the operation of the pump motor to a stop instant of stopping the operation of the pump motor;

comparing the elapsed time to a predetermined set time; and based on a result of comparing the elapsed time to the predetermined set time, determining (i) that an error has occurred in the detergent pump or (ii) the mode of the washing process.

19. The method of claim 18, wherein (i) stopping the washing process or (ii) selecting the mode of the washing process corresponding to the state of the detergent and performing the selected mode of the washing process comprises:

determining the mode of the washing process to be a first mode based on a determination that the elapsed time is less than a first set time;

determining the mode of the washing process to be a second mode based on a determination that the elapsed time is greater than or equal to the first set time and less than a second set time; and determining to stop the washing process based on a determination that the elapsed time is greater than or equal to the second set time and less than a third set time.

20. The method of claim 18, wherein determining (i) that the error has occurred in the detergent pump or (ii) the mode of the washing process comprises:

determining that the error has occurred in the detergent pump based on a determination that the elapsed time is greater than or equal to a set time, wherein (i) stopping the washing process or (ii) selecting the mode of the washing process corresponding to the state of the detergent and performing the selected mode of the washing process comprises:

determining to stop the washing process, and based on a determination that the error has occurred in the detergent pump, generating a visual alarm or an auditory alarm including predetermined information via a display or a sound outputter, or transmitting a signal including the predetermined information to a terminal of a user, and wherein the predetermined information comprises information indicating that the error has occurred in the detergent pump or information indicating that the washing process is in a stop condition.

* * * * *